US007802627B2

(12) United States Patent
Hofman et al.

(10) Patent No.: US 7,802,627 B2
(45) Date of Patent: Sep. 28, 2010

(54) REMOTELY OPERATED SELECTIVE FRACING SYSTEM AND METHOD

(75) Inventors: Raymond A. Hofman, Midland, TX (US); Gary L. Ragsdale, San Antonio, TX (US); Stephen W. Cook, Helotes, TX (US); Paul A. Avery, San Antonio, TX (US)

(73) Assignee: Summit Downhole Dynamics, Ltd, Midland, TX (US)

( * ) Notice: Subject to any disclaimer, the term of this patent is extended or adjusted under 35 U.S.C. 154(b) by 588 days.

(21) Appl. No.: 11/657,797

(22) Filed: Jan. 25, 2007

(65) Prior Publication Data

US 2007/0204995 A1 Sep. 6, 2007

Related U.S. Application Data

(60) Provisional application No. 60/762,203, filed on Jan. 25, 2006.

(51) Int. Cl.
*E21B 34/06* (2006.01)

(52) U.S. Cl. ..... 166/386; 166/66.7; 166/177.1; 166/373; 137/38; 251/68

(58) Field of Classification Search ..... 166/66.6, 166/66.7, 177.1, 373, 386; 137/38; 251/68
See application file for complete search history.

(56) References Cited

U.S. PATENT DOCUMENTS 3,007,523 A * 11/1961 Vincent ..... 166/281
3,254,720 A * 6/1966 Huitt et al. ..... 166/55
4,373,582 A * 2/1983 Bednar et al. ..... 166/66.4
6,481,494 B1 * 11/2002 Dusterhoft et al. ..... 166/51
6,943,697 B2 9/2005 Ciglenec et al.

OTHER PUBLICATIONS

M. Hopmann;"Pulse Communication Technology Enables Remote Actuation & Manipulation of Downhole Completion Equipment in Extended Reach & Deepwater Application";1996; 9 pgs.

V. Shah, et al.; "A Simple Acoustic Wave Propagation Model for Interventionless Well Completions"; 2001; 11 pgs; SPE Annual Technical Conference.

* cited by examiner

*Primary Examiner*—David J Bagnell
*Assistant Examiner*—Robert E Fuller

(57) ABSTRACT

A remotely-operated selective fracing system and valve. The valve comprises a casing with at least one casing hole; an inner sleeve nested within the casing and having at least one sleeve hole alignable with the at least one casing hole; actuator means engagable with the inner sleeve for moving the inner sleeve relative to the casing to selectively align the at least one sleeve hole with the at least one casing hole; and receiver means electrically connected to the actuator means and having a sensor for detecting a seismic or electromagnetic signal generated by a remote source. The system further includes source means for generating an acoustical signal receivable by the receiver means.

11 Claims, 21 Drawing Sheets

30
4
68b
122b
126
3C
28
42
48b
64
44
56
46
78
80
62
50
58
52
48
40
54
48a
68a
122a 61
60

REMOTELY OPERATED SELECTIVE FRACING SYSTEM AND METHOD

CROSS REFERENCE TO RELATED APPLICATION

This is an original non-provisional application claiming benefit of U.S. Provisional Application 60/762,203, filed Jan. 25, 2006, which is incorporated herein by reference.

BACKGROUND OF THE INVENTION

1. Field of the Invention

The present invention includes a system for remotely operating sliding valves of a fracing system for production of fluids, such as oil or natural gas. Sliding valves may be selectively opened or closed according to preference of a well operator.

2. Description of the Related Art

Fracing is a method of stimulating a subterranean formation to increase the production of fluids, such as oil or natural gas. In hydraulic fracing, a fracing fluid is injected through a wellbore into the formation at a pressure and flow rate at least sufficient to overcome the pressure of the reservoir and extend fractures into the formation. The fracing fluid may be one of any number of different media, including, but not limited to, sand and water, bauxite, foam, liquid carbon dioxide, or nitrogen. The fracing fluid keeps the formation from closing back upon itself when the pressure is released. Injecting fracing fluid into the formation provides channels through which the formation fluids, such as oil and gas, can flow into the wellbore and be produced.

Rudimentary fracing methods require cementing a well casing in place and then perforating the well casing at the producing zones, a process that requires packers between the various stages of the producing zone. U.S. Pat. No. 6,446,727 (the '727 patent) shows perforating the well casing to gain access to the producing zone. Perforating the well casing requires setting off an explosive charge in the producing zone, which can many times cause damage to the formation. In addition, once the well casing is perforated, isolating a particular zone becomes difficult, normally requiring the use of packers both above and below the zone.

U.S. Pat. No. 5,894,888 (the '888 patent) also shows an example of producing in the open hole by perforating the well casing. One problem with the '888 patent, however, is that the fracing fluid is delivered over the entire production zone, thus preventing concentrated pressures in preselected areas of the formation. Once the well casing is perforated, it is very difficult to restore and selectively produce certain portions of the zone and not produce other portions of the zone.

When fracing with sand, sand can accumulate and block flow. U.S. Published Application 2004/0050551 (the '551 application) shows fracing through a perforated well casing and the use of shunt tubes to give alternate flow paths. The '551 application, however, does not provide a method for alternately producing from different zones or stages of a formation.

One method used in producing horizontal formations is to provide a well casing in the vertical hole almost to the horizontal zone being produced. At the bottom of the well casing, one or more holes extend horizontally. A liner hanger is set at the bottom of the well casing with production tubing then extending into the open hole. Packers are placed between each stage of production in the open hole, with sliding valves along the production tubing opening or closing depending upon the stage being produced. U.S. Published Application 2003/0121663 shows packers separating different zones to be produced with nozzles (referred to as "burst disks") placed along the production tubing to inject fracing fluid into the formations. There are, however, disadvantages to this particular method. For one, the fracing fluid will be delivered the entire length of the production tubing between packers. This means there will not be a concentrated high pressure fluid being delivered to a small area of the formation. Also, the packers are expensive to run and set inside of the open hole in the formation.

Published patent applications 2004/0129422, 2004/0118564, and 2003/0127227 show packers used to separate different producing zones. The producing zones, however, may be along long lengths of the production tubing rather than in a concentrated area.

U.S. Pat. No. 7,267,172 to Hofman shows a method and apparatus for overcoming many of the problems associated with fracing. Production tubing and sliding valves are cemented in place in the open hole. When an area is to be fraced, a sliding valve is opened, the cement is dissolved by acid or other dissolvent to allow access to the formation only adjacent to the sliding valve. By selectively opening one or more valves along the production tubing, the well operator can concentrate high pressure fracing fluid to a small area of the formation adjacent the open sliding valve, while the undissolved cement prevents the migration of the fracing fluid to other areas. The high pressure fracing fluid thus penetrates deeper into the formation, facilitating recovery of greater amounts of fluids while using less fracing fluid.

Manual shifting of the sliding valves, however, is both time consuming and cumbersome. A shifting tool must be manually lowered sometimes great distances with a shifting string into the production tubing, engage the desired sliding valve, and then move the sliding valve to the desired position. If a well operator wishes to open multiple sliding valves (or close multiple sliding valves), the process takes even more time, as each sliding valve must be manually manipulated with the shifting tool. The shifting tool must be inserted and removed each time it is used. The process must be repeated when closing one sliding valve and opening another sliding valve, as shown in the Hofman application.

The present invention simplifies and expedites the process of shifting the sliding valves in the producing regions by remotely operating sliding valves.

SUMMARY OF THE INVENTION

It is an object of the present invention to provide an apparatus for remotely operating sliding valves in a fracing system.

It is another object of the present invention to provide an apparatus for remotely operating the sliding valves used in a fracing system such that the sliding valves may be operated individually or in combination with other valves, thus selecting certain stages to be fraced, but not other stages.

A well used to produce hydrocarbons is drilled into the production zone. Once in the production zone, either a single hole may extend therethrough, or there may be multiple holes in vertical or lateral configurations into the production zone connecting to a single wellhead. A well casing is cemented into place below the wellhead. However, in the production zone, there will be an open hole. By use of a liner hanger at the end of the well casing, production tubing is run into the open hole, which production tubing will have sliding valves located therein at preselected locations. The production tubing and sliding valves are cemented solid in the open hole. Thereafter, by transmitting a signal that is received remotely by a sliding valve controller located at a sliding valve, preselected sliding valves can be opened and the cement there-around dissolved by a suitable acid or other solvent. Once the cement is dissolved, fracing may begin adjacent the preselected sliding valves. Any combination of sliding valves can be opened and dissolve the cement there-around. In this manner, more than one area can be fraced at a time.

After dissolving the cement surrounding the valves, a fracing fluid is injected through the production tubing and the preselected sliding valves into the production zone adjacent thereto. The fracing fluid can be forced further into the formation by having a narrow annulus around the preselected sliding valves in which the fracing fluid is injected into the formation. The undissolved cement prevents migration of the fracing fluid. This causes the fracing fluid to go deeper into the petroleum producing formation. By remote operation of the sliding valves, any number or combination of the sliding valves can be opened at one time. If the well operator desires to shut off a portion of the producing zone because it is producing water or is an undesirable zone, the sliding valve can be closed remotely.

In order to operate a particular sliding valve or combination thereof, the well operator first identifies which valve or valves are to be operated. The well operator then generates a signal that contains addressing information for the particular valves to be operated as well as coded data indicating the state—either opened or closed—to which the valve should be moved. This signal is then received by a sliding valve, which includes a microprocessor. If the microprocessor determines from the addressing information that the signal is intended for the sliding valve, it further determines whether the signal indicates the valve should be moved to the opened or closed state. If the valve is not in the proper position, actuator means move an inner sleeve of the valve to the desired position.

Transmission of the signal to open or close the valve may be sent by any means through which a specific valve may be individually addressed, including, but not limited to:

- transmitting an electromagnetic signal down the wellbore to the sliding valve controller;
- transmitting a low frequency signal through the earth to the sliding valve controller;
- transmitting an audio signal down the wellbore to the sliding valve controller;
- pumping a transmitting device down the wellbore to the sliding valve;
- directly connecting a cable from the sliding valve controller to the transmitting device;
- utilizing the pipe or well casing wall as a transmission medium for sending a signal through the wellbore or directly to the sliding valves;
- communicating with the sliding valve controller by changing the pressure within the wellbore in a predictable pattern;
- communicating with the shifter by sending vibrations through the earth that are detected by the shifter;
- programming the shifter to operate on a predetermined schedule; or
- relaying the information to and between the various sliding valves by electromagnetic or other signal.

The method of shifting the valve from the opened to the closed position (or from the closed to the opened position) may be by any means sufficient to move the inner sleeve of the sliding valve from one position to the other, including, but not limited to:

- a bidirectional motor that engages the movable part of the valve through frictional, threaded, or other means, whereby the motor is switched ON or OFF in the appropriate direction according to control signals received from a microprocessor;
- moving the valve hydraulically according to control signals generated from a microprocessor; and
- generating a control signal from the microprocessor that activates an explosive charge or chemical reaction that propels the inner sleeve of the valve to the appropriate position.

The method of remotely shifting the sliding valves operates in such a manner so as not to interfere with the well operator's ability to shift the valves manually with a shifting tool if desired.

BRIEF DESCRIPTION OF THE SEVERAL VIEWS OF THE DRAWING

The present invention, as well as further objects and features thereof, are more clearly and fully set forth in the following description of the preferred embodiment, which should be read with reference to the accompanying drawings, wherein.

DESCRIPTION OF THE INVENTION

Figure 1A:
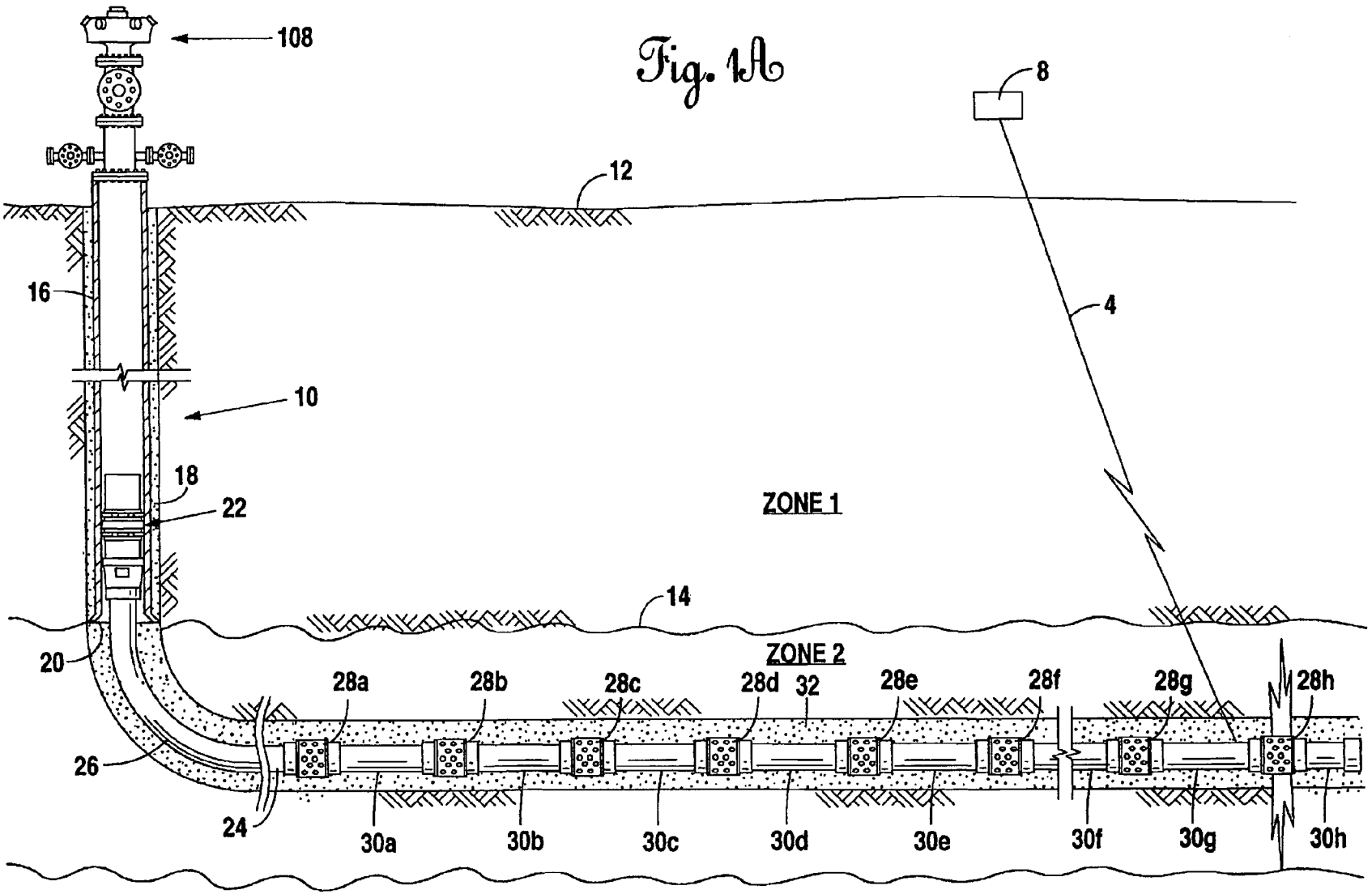
FIG. 1A shows a remotely operated selective fracing system in which communication to sliding valves is by low frequency electromagnetic signals transmitted through the earth.

FIG. 1A illustrates a remotely operated selective fracing system. A production well 10 is drilled in the earth 12 to a hydrocarbon production zone 14. A well casing 16 is held in place in the production well 10 by cement 18. A well operator controls operation of the well through wellhead 108, which attaches to the well casing 16 at the surface. This allows for a well operator to perform normal production functions, such as check the pressure in the well or pump fluid into the well.

At the lower end 20 of production well casing 16 is located liner hanger 22, which may be either hydraulically or mechanically set. Below the liner hanger 22 extends production tubing 24. To extend laterally, the production well 10 and production tubing 24 bend around a radius 26. The radius 26 may vary from well to well and may be as small as thirty feet and as large as 400 feet. The radius 26 of the bend in production well 10 and production tubing 24 depends upon the formation and equipment used.

Inside of the hydrocarbon production zone 14, the production tubing 24 has a series of sliding valves 28*a*-28*h*. The distance between the sliding valves 28*a*-28*h* may vary according to the preference of the particular operator. A normal distance is the length of a standard production tubing segment (thirty feet) although the length may vary depending upon where the sliding valves 28*a*-28*h* should be located in the formation. The production tubing 24, sliding valves 28*a*-*h*, and the production tubing segments 30 are encased in cement 32, which may be different from the cement 18 located around the well casing 16.

Sliding valves 28*a*-28*h* may be opened or closed remotely in any order or sequence. A well operator who wishes to control one or more of the sliding valves 28*a*-28*h* inputs information into control box 8, which encodes the information into an electromagnetic signal 4 that is sent through the earth 12 and received by sliding valves 28*a*-28*h*. Because the earth 12 is a lossy medium, the electromagnetic signal 4 must be of relatively low frequency (and therefore long wavelength) to penetrate the earth 8 and reach the sliding valves 28*a*-28*h*. All sliding valves 28*a*-28*h* receive the electromagnetic signal 4; each of the sliding valves 28*a*-28*h* then determines whether the information encoded in the electromagnetic signal 4 is intended for it.

Figure 1B:
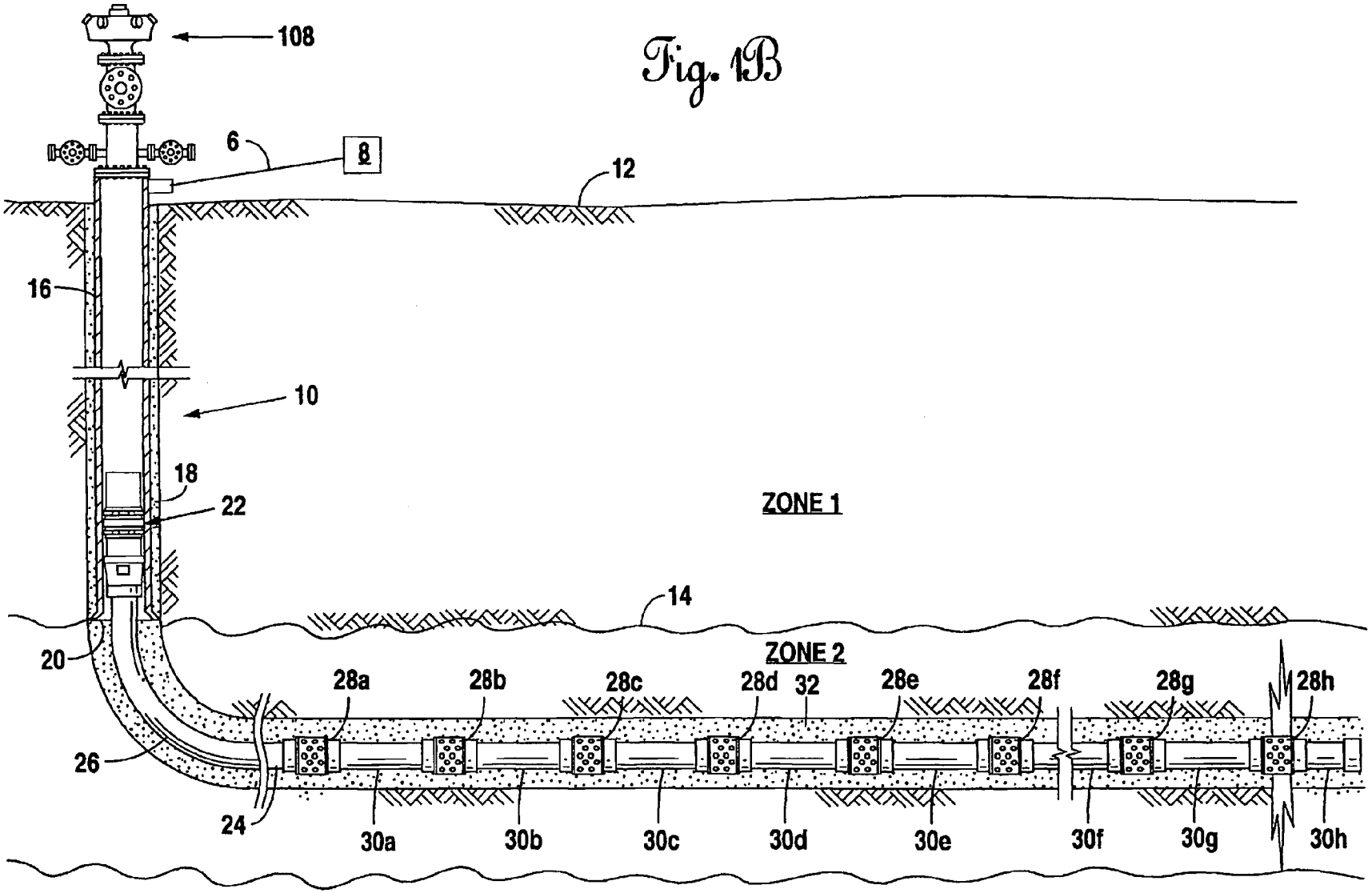
FIG. 1B shows a remotely operated selective fracing system in which communication to sliding valves is transmitted using the well casing wall and production tubing as a transmission medium.

FIG. 1B depicts a remotely operated selective fracing system that uses the casing as a transmission medium for communicating with sliding valves 28*a*-28*h*. Control box 8 accepts information from a well operator who wishes to open or close one or more of the sliding valves 28*a*-28*h*, encodes the information into an electromagnetic signal, and transmits the electromagnetic signal through wire 6 to well casing 16. The well casing 16 then acts as a transmission medium for the electromagnetic signal, which is broadcast down the wellbore through the liner hanger 22 and production tubing 24 to the sliding valves 28*a*-28*h*. The electromagnetic signal is received by each of the sliding valves 28*a*-28*h* in the system, then each determines whether it needs to open or close.

Figure 1C:
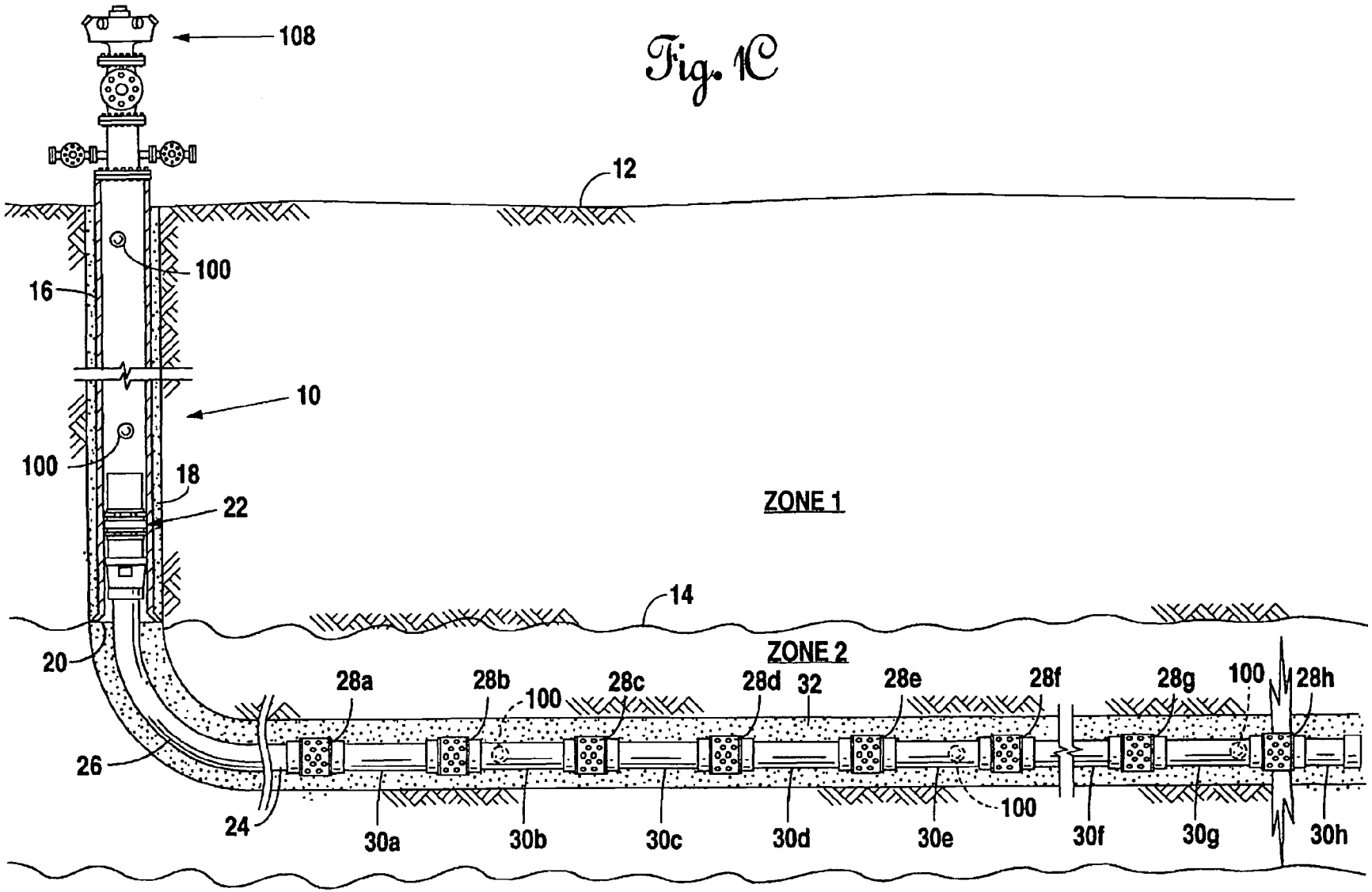
FIG. 1C shows a remotely operated selective fracing system in which communication to sliding valves is effectuated by pumping transmitting devices into the wellbore.

FIG. 1C shows a remotely operated selective fracing system whereby communication with the sliding valves 28*a*-28*h* is effected with control balls 100 pumped into the production well 10. The control balls 100 enclose components necessary to accept input from a well operator prior and later retransmit this information via electromagnetic signal as the control balls 100 travel through the production well 10, production tubing 24, and production tubing segments 30, including at least a battery and transmitter for generating an electromagnetic signal to be received by the sliding valves 28*a*-28 *h*. The control balls 100 are constructed in such fashion so as to prevent fluid from entering the balls, thereby protecting the internal components, and are of such buoyancy so as to allow the control balls 100 to easily flow with the fluid as the fluid is pumped through the well.

Before pumping a control ball 100 through the production well 10, a well operator programs the control ball 100 with the data representing which of the sliding valves 28*a*-28*h* are to be operated and the desired states thereof. Thereafter, the control ball 100 is pumped into the production well 10, into the production tubing 24, and the production tubing segments 30, passing each of the sliding valves 28*a*-28*h* as it moves toward the end of the well. As the control ball 100 travels through the production well 10, it emits an electromagnetic signal containing the coded information previously programmed by the well operator, which is received by the sliding valves 28*a*-28*h*. From the information encoded in the electromagnetic signal, each of the sliding valves 28*a*-28*h* then determines whether it is to be operated and, if so, whether it should open or close. The strength of the electromagnetic signal need only be enough so that each of the sliding valves 28*a*-28*h* receives the electromagnetic signal as it passes each of the valves, although the control balls 100 could emit stronger signals so that each of the sliding valves 28*a*-28*h* receives the electromagnetic signal before or when the control ball 100 reaches the radius 26 of the tubing. After the control ball 100 travels the length of the production well 10, it may either be retrieved at a later time or permanently left in the well.

Figure 2A:
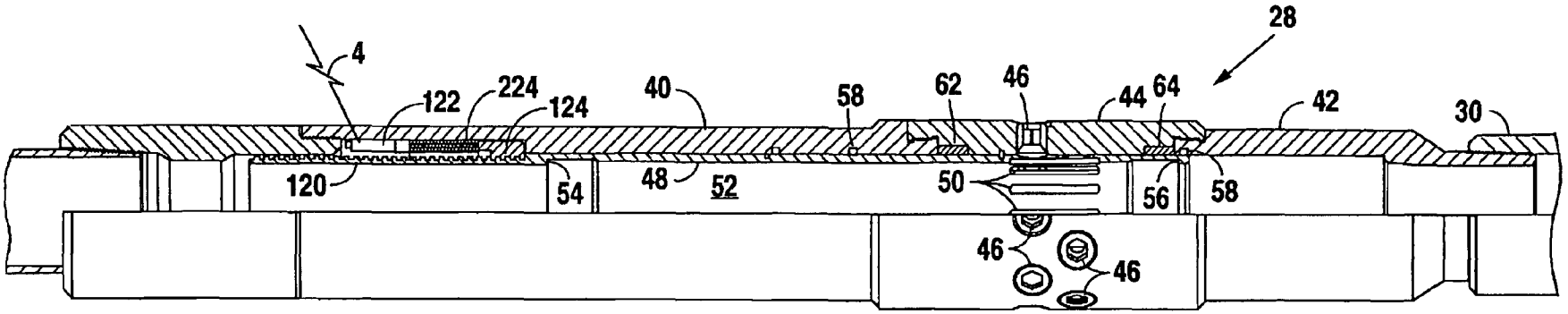
FIG. 2A shows a sliding valve in the opened position that is moved between the opened and closed positions by engaging threads located on the outside of the inner sleeve.

FIG. 2A shows a partial cross-sectional view of a sliding valve 28 in the opened position whereby an inner sleeve 48 is moved between the opened and closed positions by engaging inner sleeve threads 120 located on one end of and on the outer surface of the inner sleeve 48. An upper housing sub 40 is connected to a lower housing sub 42 by threaded connections via the casing 44, and lower housing sub 42 further connects to a production tubing segment 30 also by threaded connections. A series of casing holes 46 extend through the casing 44. Inside the inner sleeve 48 are sleeve holes 50 that allow fluid flow from the inside passage 52 through the sleeve holes 50 and casing holes 46 to the outside of the sliding valve 28. The inner sleeve 48 has an opening shoulder 54 and a closing shoulder 56 located therein, which may be used to move the inner sleeve 48 with a mechanical shifting tool as detailed in U.S. Pat. No. 7,267,172 ("Cemented Open Hole Selective Fracing System") to Hofman, incorporated herein by reference. The sliding valve 28 has wiper seals 58 between the inner sleeve 48 and the upper housing sub 42 and the lower housing sub 44. The wiper seals 58 keep debris that could interfere with operation from getting back behind the inner sleeve 48, which is particularly important when sand is part of the fracing fluid. Also located between the inner sleeve 48 and casing 44 is a C-clamp 60 that fits in a notch undercut in the casing 44 and into a C-clamp notch 61 in the outer surface of inner sleeve 48. The C-clamp 60 puts pressure in the C-clamp notch 61 and prevents the inner sleeve 48 from being accidentally moved to an unwanted position. Seal stacks 62 and 64 are compressed between (1) the upper housing sub 40 and casing 44 and (2) lower housing sub 42 and casing 44 respectively, thus preventing leakage from the inner passage 52 to the area outside sliding valve 28 when the sliding valve 28 is closed.

Figure 2B:
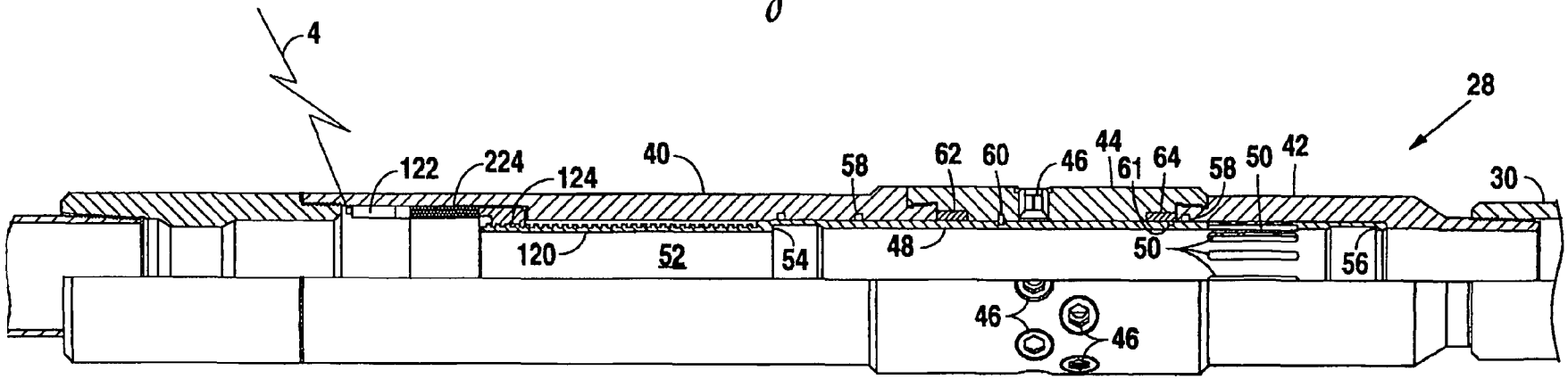
FIG. 2B shows a sliding valve in the closed position that is moved between the opened and closed positions by engaging threads located on the outside of the inner sleeve.
Figure 5A:
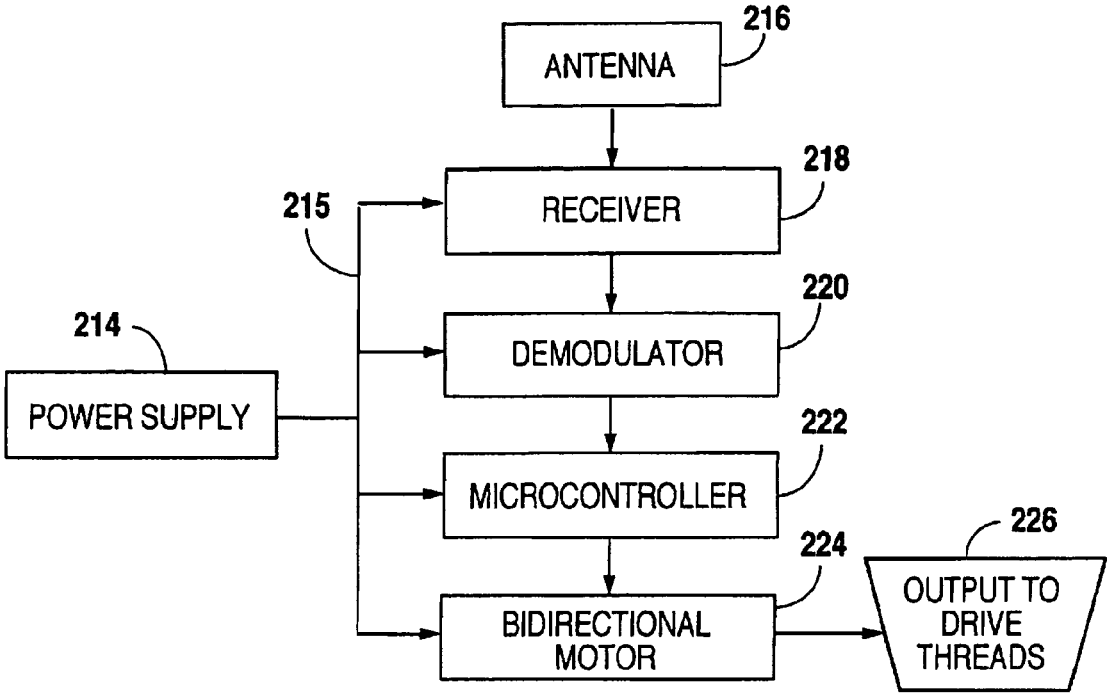
FIG. 5A and FIG. 5B are block diagrams that depict the functionality of the sliding valve controllers, including actuation means and receiver means, used in the described embodiments.

Sliding valve controller 122, the internal functionality of which is detailed in FIG. 5A, receives an electromagnetic signal 4 containing coded information from a well operator who desires to remotely operate one or more valves 28*a-h* in the system. The sliding valve controller 122 decodes the information, then first determines whether the state of the sliding valve 28 it controls should change. If the state of the sliding valve 28 should change, the sliding valve controller 122 turns drive threads 124, which are mated with inner sleeve threads 122, in the appropriate direction. Turning the drive threads 124 in one direction causes the inner sleeve 48 to move toward and to the closed position, while turning drive threads 124 in a second, opposite direction causes inner sleeve 48 to move toward and to the opened position. FIG. 2B, for example, shows a partial cross-sectional view of sliding valve 28 in the closed position, wherein the sliding valve controller 122 has turned the drive threads 124 and moved the inner sleeve 48 such that the sleeve holes 50 and casing holes 46 are not aligned, thus preventing fluid flow from the inside passage 52 through the sleeve holes 50 and casing holes 46 to the outside of the sliding valve 28.

Figures 3A, 3B, 3C, 3D:
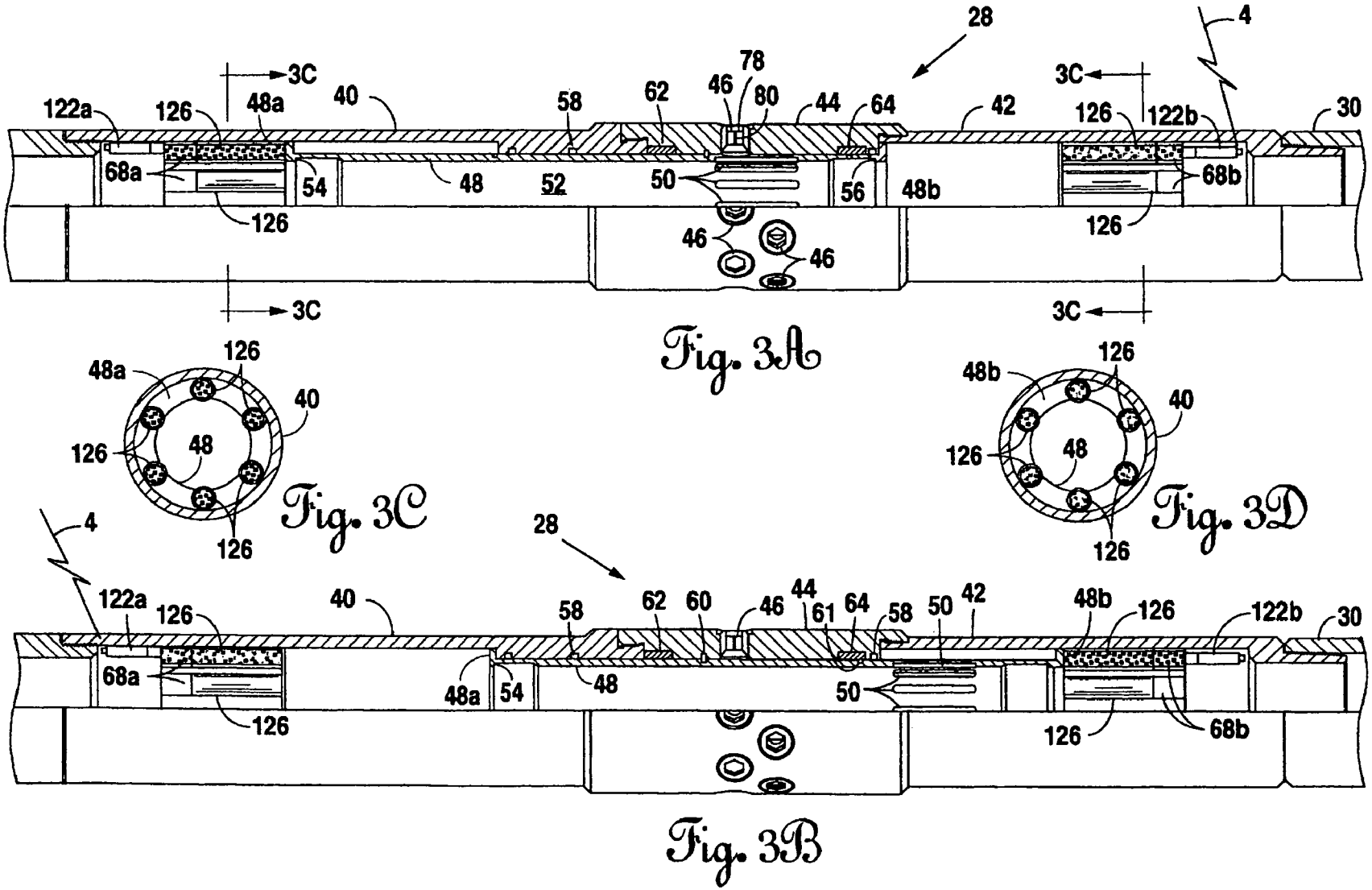
FIG. 3A shows a sliding valve in the opened position that is moved between the opened and closed positions by firing explosive charges located within the sliding valve.
FIG. 3B shows a sliding valve that has moved to the closed position by firing explosive charges located within the sliding valve.
FIG. 3C depicts a sectional view along section line 3C-3C of FIG. 3A.
FIG. 3D shows a sectional view along section line 3D-3D of FIG. 3A.

FIGS. 3A, 3B, 3C and 3D show another embodiment of the invention, wherein inner sleeve 48 is moved between the opened and closed positions by firing explosive charges 126. When fired by the sliding valve controllers 122*a*, 122*b*, the explosive charges 126 push the inner sleeve 48 between the opened and closed positions. Movement past the opened and closed positions is limited by the inner sleeve lips 48*a*, 48*b*, which run into and are stopped by the upper housing sub 40 and casing 44 respectively as the inner sleeve 48 moves to each position. Explosive charges 126 could be fired in pairs to minimize the torque on inner sleeve 48 about its cylindrical axis. As shown in FIGS. 3C and 3D, depicting partial cross-sectional views of sliding valve 28 along section lines 3C-3C and 3D-3D of FIG. 3A respectively, there are a fixed number of explosive charges 126, which cannot be reused. Thus, this embodiment only allows the inner sleeve 48 to move between the opened and closed positions a fixed number of times, which fixed number is a function of the number of explosive charges 126 and how many of the explosive charges 126 are fired each time the inner sleeve 48 is moved.

In FIGS. 3A and 3B, the sliding valve controllers 122*a*, 122*b* receive an electromagnetic signal 4 containing coded information from a well operator who desires to remotely operate one or more of the valves in the system. The sliding valve controllers 122*a*, 122*b* decode the information from the electromagnetic signal 4, then determine whether the sliding valve 28 should change states. The sliding valve controllers 122*a*, 122*b* next determine whether the inner sleeve 48 is in the opened or closed position. If, based upon the information coded in the electromagnetic signal 4, the state of the sliding valve 28 should change, the appropriate sliding valve controller 122*a*, 122*b* sends a control signal to one of the initiators 68*a*, 68*b*, which in turn detonates one or more explosive charges 126 to propel the inner sleeve 48 to the other position. The initiators 68*a*, 68*b* serve both to match the control signal from the sliding valve controller 122*a*, 122*b* to the appropriate explosive charges 126 and to insulate the sliding valve controllers 122*a*, 122*b* from any explosive backlash caused from firing the charges. In FIG. 3A, sliding valve controller 122*b* has received electromagnetic signal 4 and detonated one or more of the explosive charges 126 resting in the charge ring 48*b*, thus propelling the inner sleeve 48 to the opened position. Similarly, in FIG. 3B, sliding valve controller 122*a* has received electromagnetic signal 4 and detonated one or more explosive charges, thus propelling inner sleeve 48 to the closed position.

Figure 4:
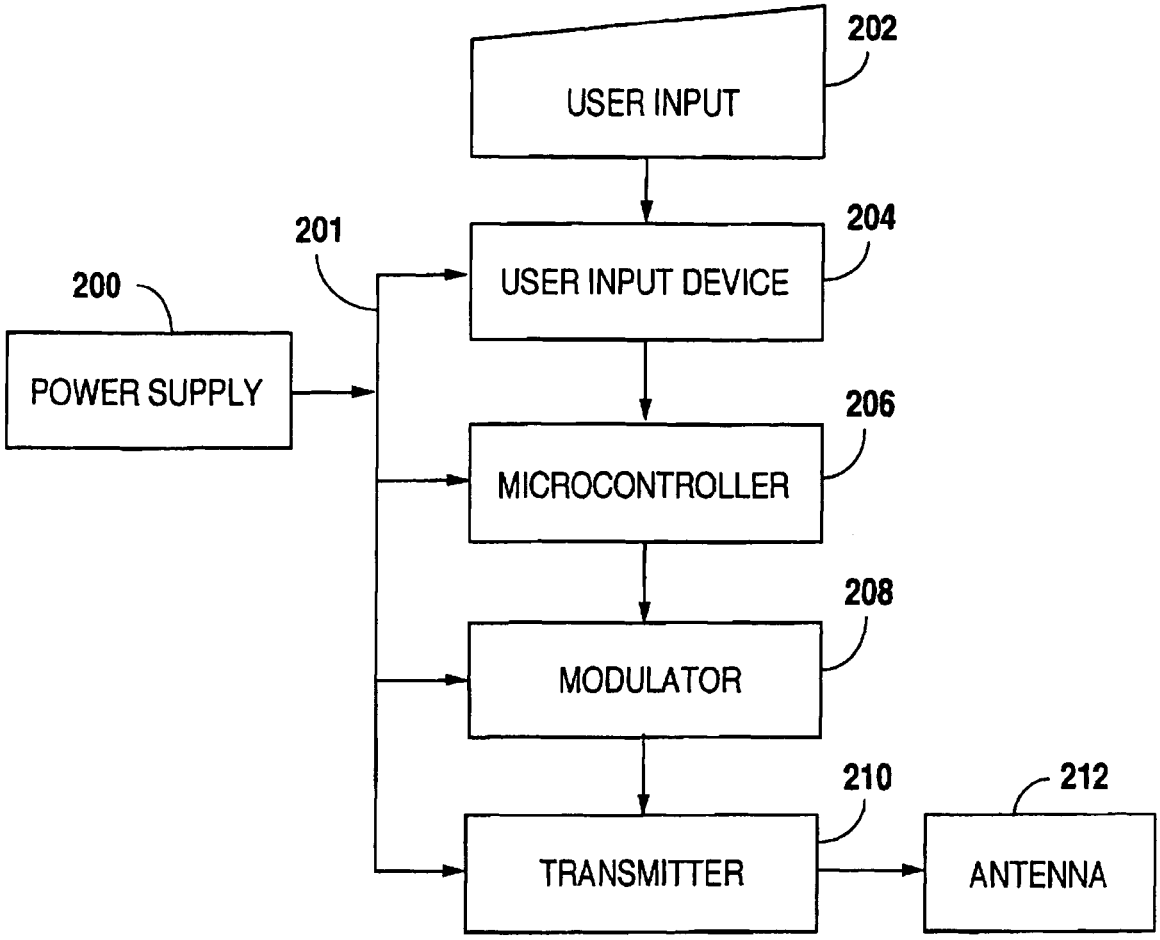
FIG. 4 shows the functionality of the transmission devices used to communicate with the sliding valves in the described embodiments.

FIG. 4 more specifically shows by block diagram the functionality of the control balls 110 shown in FIG. 1C and control boxes 8 shown in FIGS. 1A and 1B, which are used to communicate with the sliding valves 28*a*-28*h*. A power supply 200 provides electric current 201 to a user input device 204, a microcontroller 206, a modulator 208, and a transmitter 210. A well operator wishing to operate one or more sliding valves of a remotely operated selective fracing system inputs the appropriate information as user input 202, consisting of at least the sliding valve to be operated and the state—whether opened or closed—that the valve is to assume, into a user input device 204. The user input device 204 then delivers the information to the microcontroller 206, which manipulates the data into a form usable and expected by the system. The microcontroller 206 then delivers the data to the modulator 208, which modulates an electromagnetic carrier signal generated by the transmitter 210. The modulated signal is then sent to an antenna 212, which converts the signal into an electromagnetic wave to be received by the sliding valves 28*a*-28*h*.

FIG. 5A more specifically shows the functionality of the sliding valve controller 122 used in the embodiment depicted by FIG. 2. A power supply 214 provides operating current 215 to a receiver 218, a demodulator 220, a bidirectional motor 224, and a microcontroller 222. The electromagnetic signal generated by a well producer's control device induces a current into an antenna, which current is received by the receiver 218. The receiver 218 delivers this modulated signal to the demodulator 220, which demodulates the signal and delivers the data contained therein to the microcontroller 222. The microcontroller 222 then determines from this data whether the sliding valve is to be moved and, if so, to what position. If the sliding valve 28 is to be moved, the microcontroller 222 sends an appropriate control signal to the bidirectional motor 224, which causes the bidirectional motor 224 to generate an output that turns the drive threads 124 in the appropriate direction, causing the inner sleeve 48 to move to the desired position.

Figure 5B:
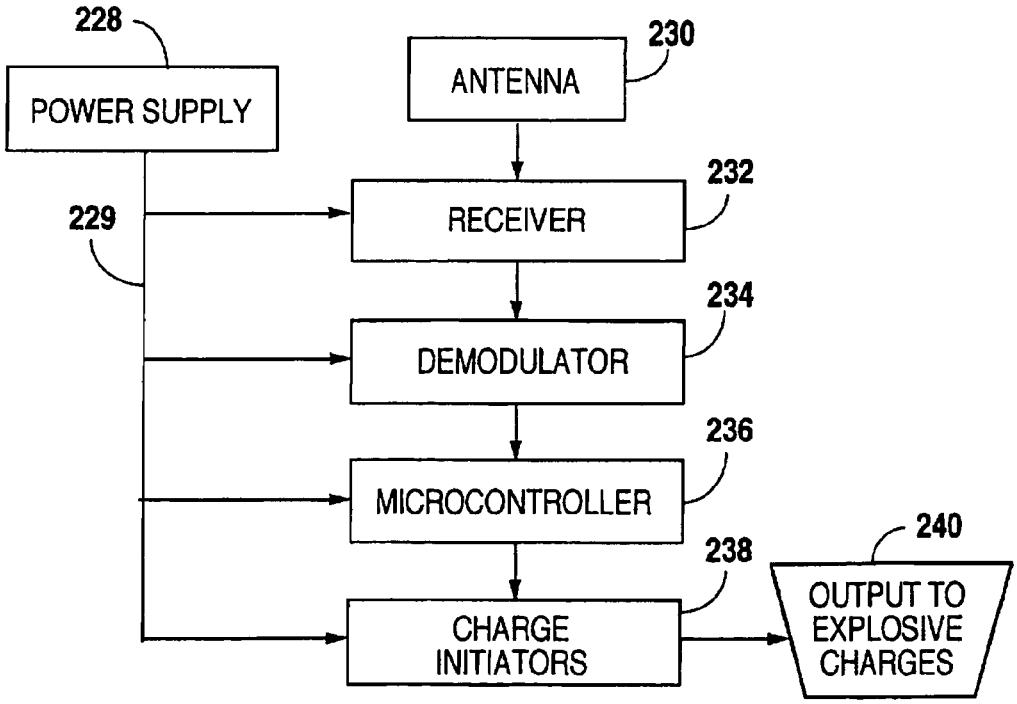

FIG. 5B more specifically shows the functionality of the sliding valve controllers 122*a*, 122*b* used in the embodiment shown by FIG. 3. A power supply 228 provides operating current 229 to a receiver 232, a demodulator 234, charge initiators 238, and a microcontroller 236. The electromagnetic wave generated by the well operator's control device induces a current into an 230 antenna, which current is received by the receiver 232. The receiver 232 delivers this modulated signal to a demodulator 234, which demodulates the signal and delivers the data contained therein to the microcontroller 236. The microcontroller 236 then determines from this data whether the sliding valve 28 is to be moved and, if so, to what position. If the sliding valve 28 is to be moved, the microcontroller 236 sends an appropriate control signal to one or more of the charge initiators 238, which send output to the explosive charges 240 causing the explosive charges 126 to detonate. The detonation of these explosive charges 126 propels the inner sleeve 48 to the desired position.

Figure 6:
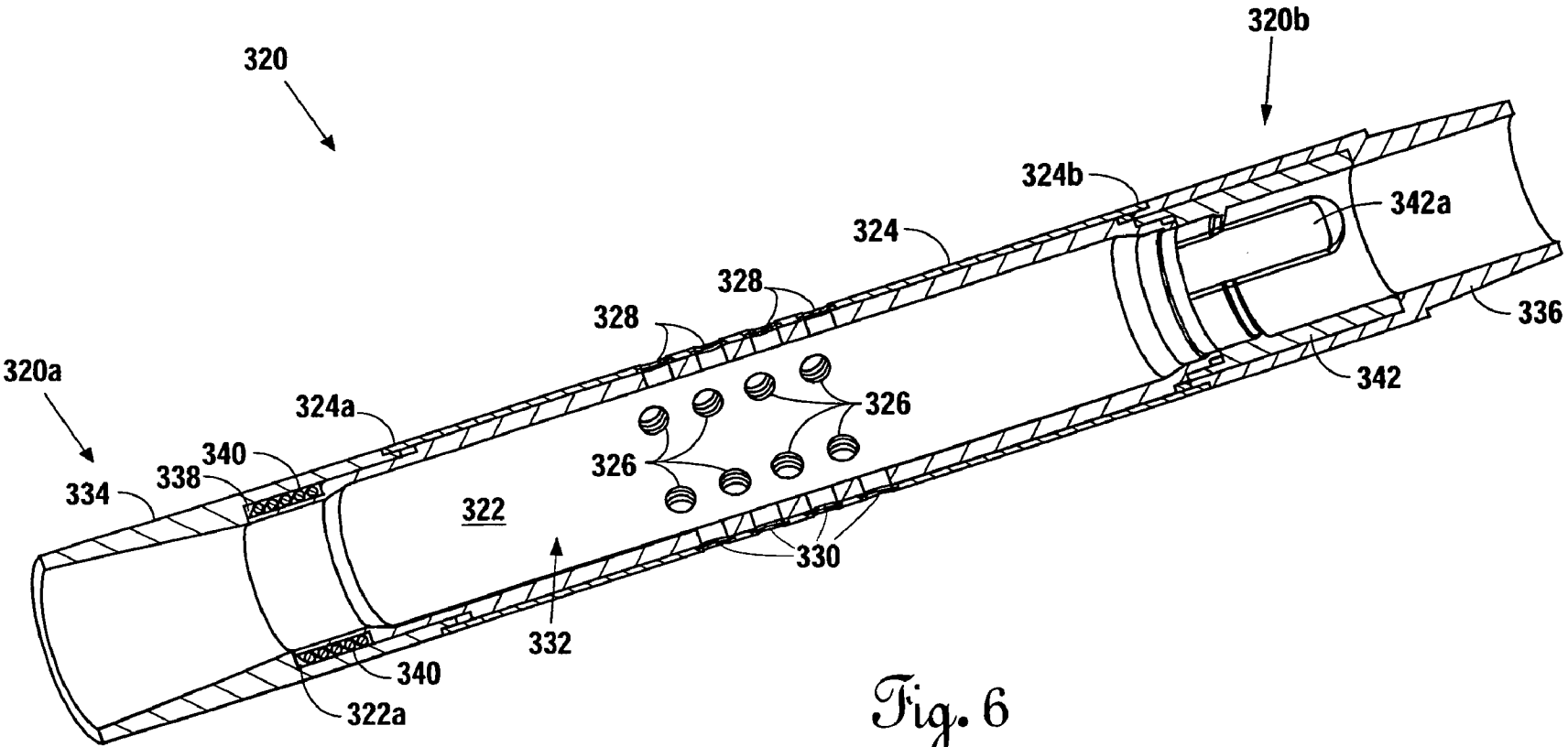
FIG. 6 discloses an alternative embodiment of the present invention.

FIG. 6 discloses an alternative embodiment of the selectively-actuatable fracing valve 320 of the present invention. The valve 320 includes an inner sleeve 322 nested within a casing 324. A plurality of sleeve holes 326 are disposed through the inner sleeve 322, as are a plurality of casing holes 328 disposed through the casing 324. The sleeve holes 326 and casing holes 328 are selectively alignable to permit fluid communication therethrough. Multiple seals 330 are interposed between the casing 324 and inner sleeve 322 to help inhibit fluid communication into inner space 332 of the valve 320 when the casing holes 328 and sleeve holes 326 are misaligned.

An upper sub 334 and lower sub 336 are threadedly connected to an upper end 324*a* and a lower end 324*b* of the casing 324 respectively. Placed within an annular space 338 between the upper sub 334 and inner sleeve 322 is a torsion spring 340 for exerting rotational force on the inner sleeve 322. The torsion spring 340 abuts a shoulder 322*a* of the inner sleeve 322 such that, when loaded, the spring 340 rotationally biases the inner sleeve 322 to rotate relative to the casing 324. At the lower end 320*b* of the valve 320, a solenoid housing 342 with a solenoid well 342*a* is fitted between the lower sub 336 and the inner sleeve 322.

Figure 7:
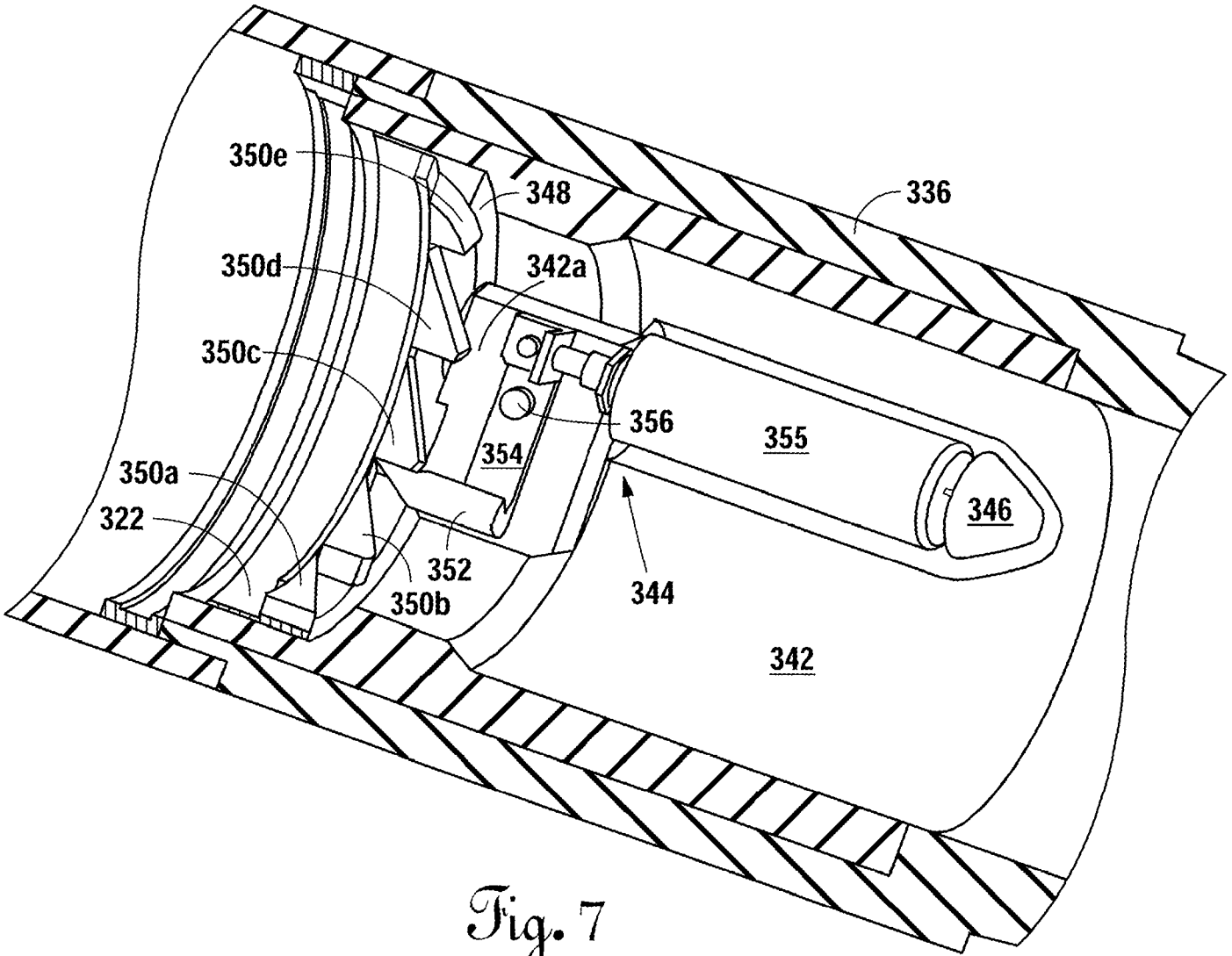
FIG. 7 more fully shows the lower sub and solenoid housing disclosed in FIG. 6.

As disclosed in FIG. 7, which shows the lower sub 336 and solenoid housing 342 in greater detail, a ratchet assembly 344 and receiver 346 are disposed within a solenoid well 342*a* in the housing 342 and within an annular space 348 between the housing 342 and lower sub 336. The ratchet assembly 344 has a solenoid 355 and a latch 352 selectively engagable with ratchet teeth 350*a*-350*e* extending from the inner sleeve 322. The teeth 350*a*-350*e* are engagable by the latch 352 connected to a pivot arm 354 that rotates about a fixed pin 356.

Figure 8B:
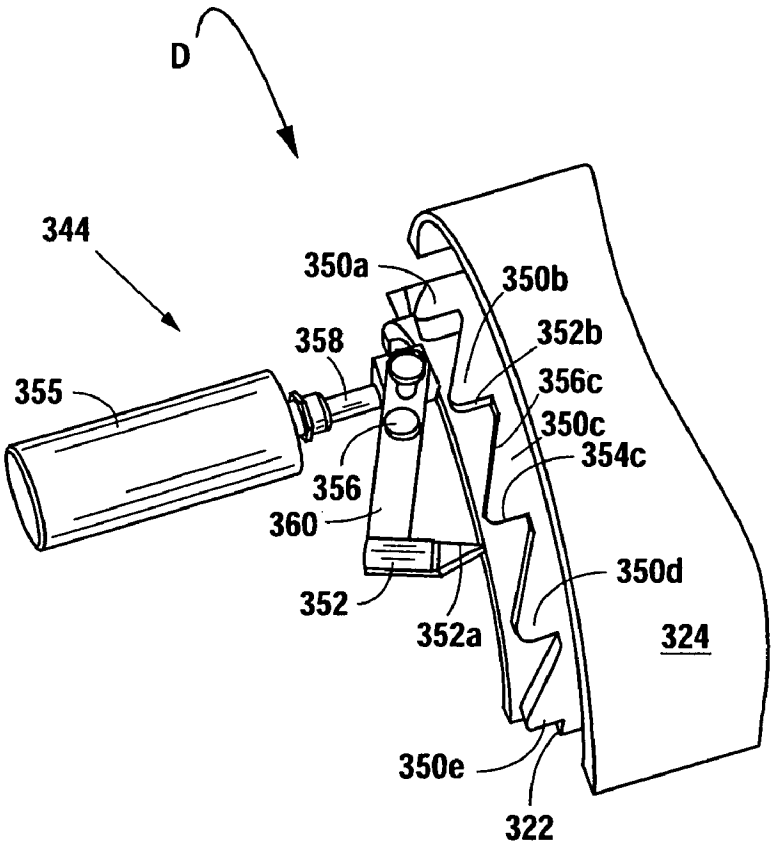
FIG. 8A and FIG. 8B shows the engagement and disengagement of the latch with ratchet teeth extending from the inner sleeve of a valve.
Figure 8A:
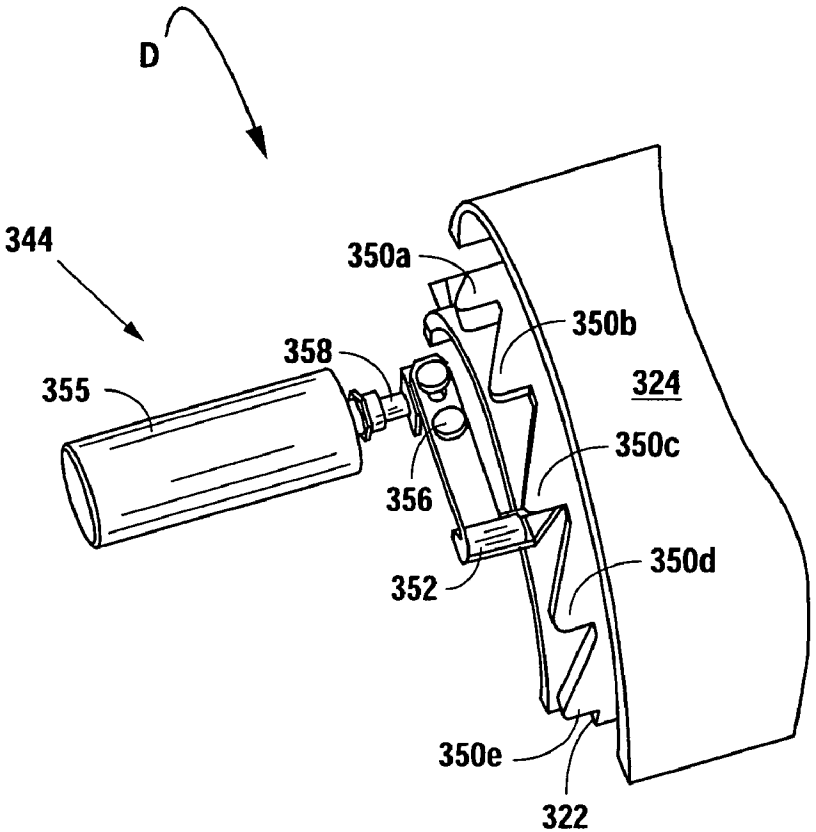

FIG. 8A and FIG. 8B more clearly show the engagement and disengagement of the latch 352 with the extending ratchet teeth 350*a*-350*e*. As shown in FIG. 6, at the upper end 320*a* of the valve 320, the loaded torsion spring 340 exerts a rotational force on the inner sleeve 322. As shown in FIG. 8A, this rotational force biases the inner sleeve 322 in rotational direction D about its longitudinal axis, but this rotation is resisted by the engagement of the latch 352 with a front surface 354*c* of a ratchet tooth 350*c*. When the tooth 350*c* is so engaged, the inner sleeve 322 cannot rotate in rotational direction D. This is the "closed" position.

As shown in FIG. 8B, when the solenoid 355 is energized, a finger 358 is extended therefrom causing the attached pivot arm 360 to rotate in about the fixed pin 356. The latch 352 is thus disengaged from the front surface 354*c* of the tooth 350*c*, and no longer resists the rotational force from the torsion spring 340 (see FIG. 6). This is the "opened" position. Shortly after this disengagement, the solenoid 355 de-energizes and the finger 358 retracts to the closed position (shown in FIG. 8A) by force of a spring return within the ratchet assembly 344. The latch 352 will tend to contact the back surface 356*c* of the previously-engaged tooth 350*c* and ride along that back surface 356*c* until the engagement surface 352*a* of the latch 352 engages the front edge 352*b* of the next tooth 350*b* to prevent further rotation of the sleeve 322.

The teeth 350*a*-350*e* are spaced such that each actuation of the mechanism will rotate the sleeve 322 22.5°, and will serve to either align or misalign the sleeve holes 326 with the casing holes 328. Thus, a full open-close cycle is attained through two actuations, which results in a 45° rotation of the inner sleeve 322. The hole pattern around the circumference of the tool, and the ratchet assembly 344, could be modified to provide more or less open-close cycles.

Figure 9:
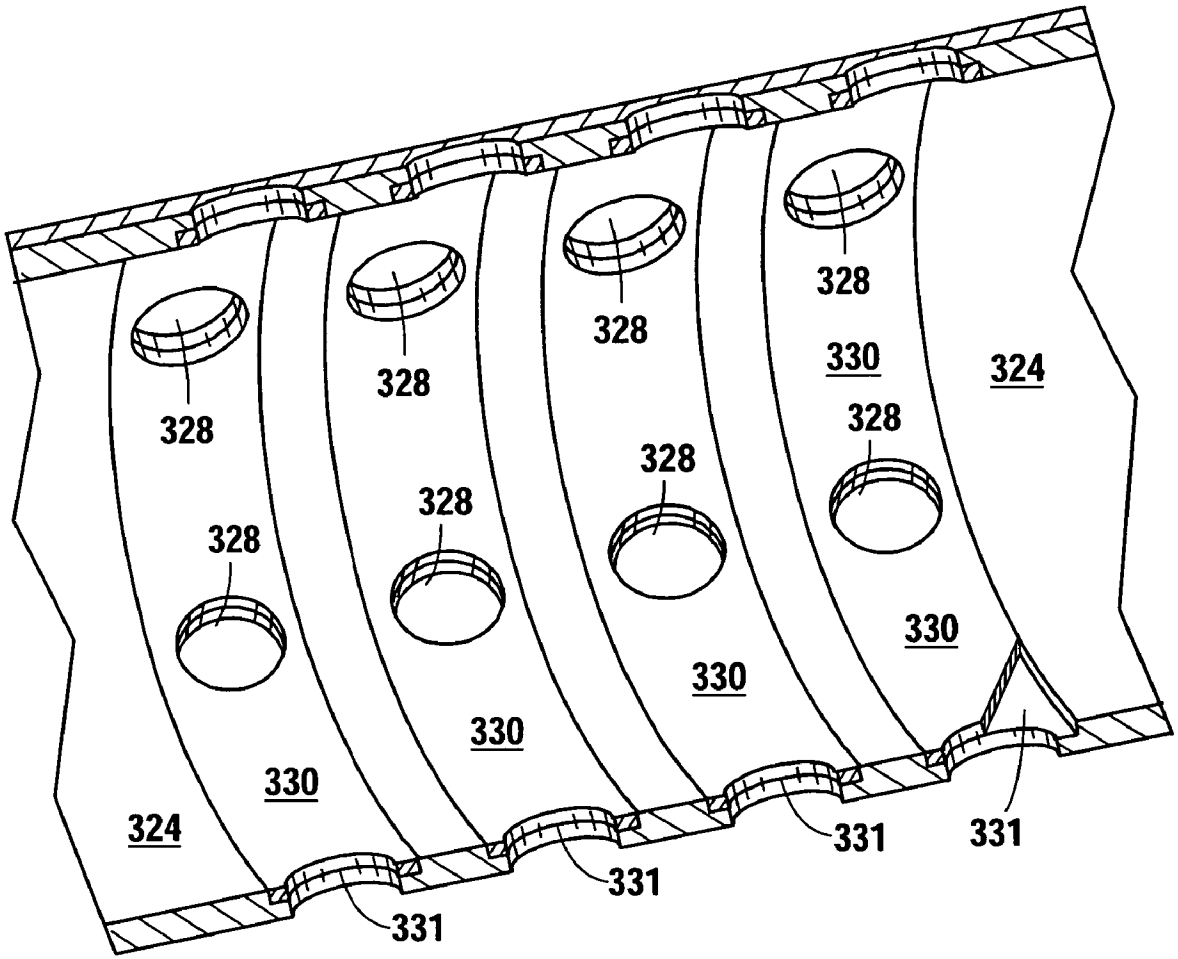
FIG. 9 illustrates a plurality of seals interposed between a casing and an inner sleeve of a selectively-actuatable valve.

As shown in FIG. 9, a plurality of seals 330 are interposed between the casing 324 and inner sleeve 322 (not shown), which are preferably hydrogenated nitrile (HNBR). These seals 330 are oriented circumferentially around the casing 324 and fitted into seal grooves 331 aligned with the casing holes 328. These seals 330 will provide the bulk of the resistance in rotating the inner sleeve 322, and thus the frictional force generated by these surfaces must be considered to estimate spring properties such as wire thickness, number of active coils, and material. This analysis must be balanced against the force applied at the interface between the ratchet teeth 350 and the latch 352, as well as the force, and thus power, requirements of the solenoid 356 (see FIGS. 8A & 8B). These calculations are known to those having ordinary skill in the art of downhole tool design.

Figure 10:
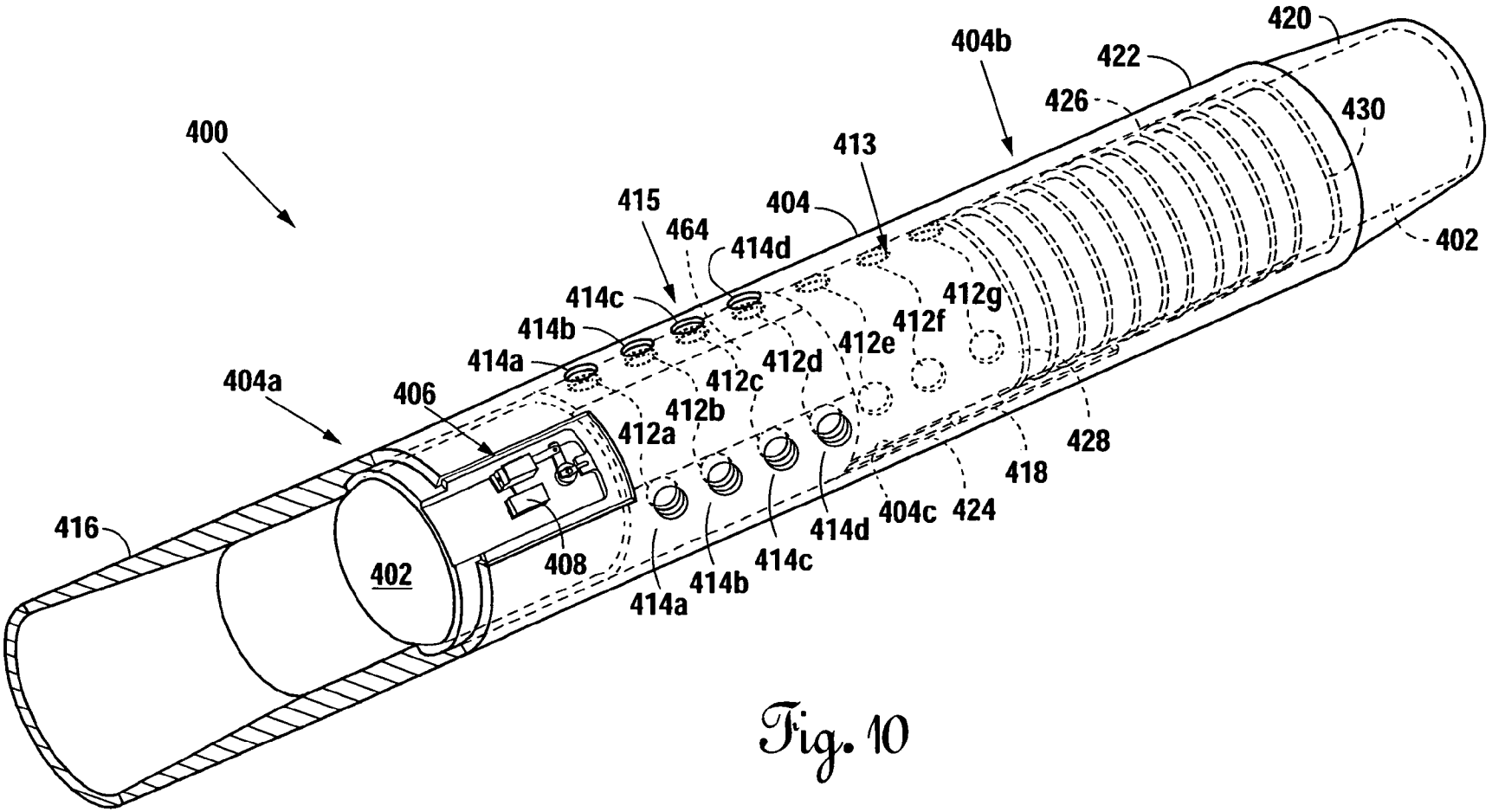
FIG. 10 shows another alternative embodiment of fracing valve.

FIG. 10 shows an alternative embodiment of a fracing valve 400. As described with reference to the preferred embodiment, the valve 400 includes an inner sleeve 402 nested within a casing 404 having actuator means 406 and receiver means 408 positioned within a housing 410 in the casing 404. A plurality of sleeve holes 412*a*-412*g* are disposed through the inner sleeve 402 in rows 413, as are a plurality of casing holes 414*a*-414*d* disposed through the casing 404 in rows 415. The sleeve holes 412 and casing holes 414 are selectively alignable to permit fluid communication therethrough. The valve 400 includes an upper sub 416 mated to the upper end 404*a* of the casing 404 and a lower sub 420 mated to a spring housing 422. The spring housing 422, in turn, is mated to the lower end 404*b* of the casing 404. The inner sleeve 402 includes a guide 418 affixed thereto insertable into a guide groove 424 longitudinally aligned in the inner surface 404*c* of the casing 404 to prevent rotation of the inner sleeve 322 as it moves linearly toward the upper end 404*a* of the casing 404, as will be described hereinafter.

A compression spring 426 is coiled around a portion of the inner sleeve 402, the portion being defined at one end by an upper shoulder 428. The spring 426 engages the upper shoulder 428 to exert expansive force on the inner sleeve 402, thus urging the sleeve 402 toward the upper end 404*a* of the casing 404. The spring housing 422 has a lower shoulder 430 to provide the other contact surface for the spring. Thus, prior to installation of the valve 400 within a production well, the spring 426 should be compressed, or "loaded," between the upper shoulder 428 and lower shoulder 430 by forcing the inner sleeve 402 through the casing 404 in the direction of the lower shoulder 430.

Figure 11:
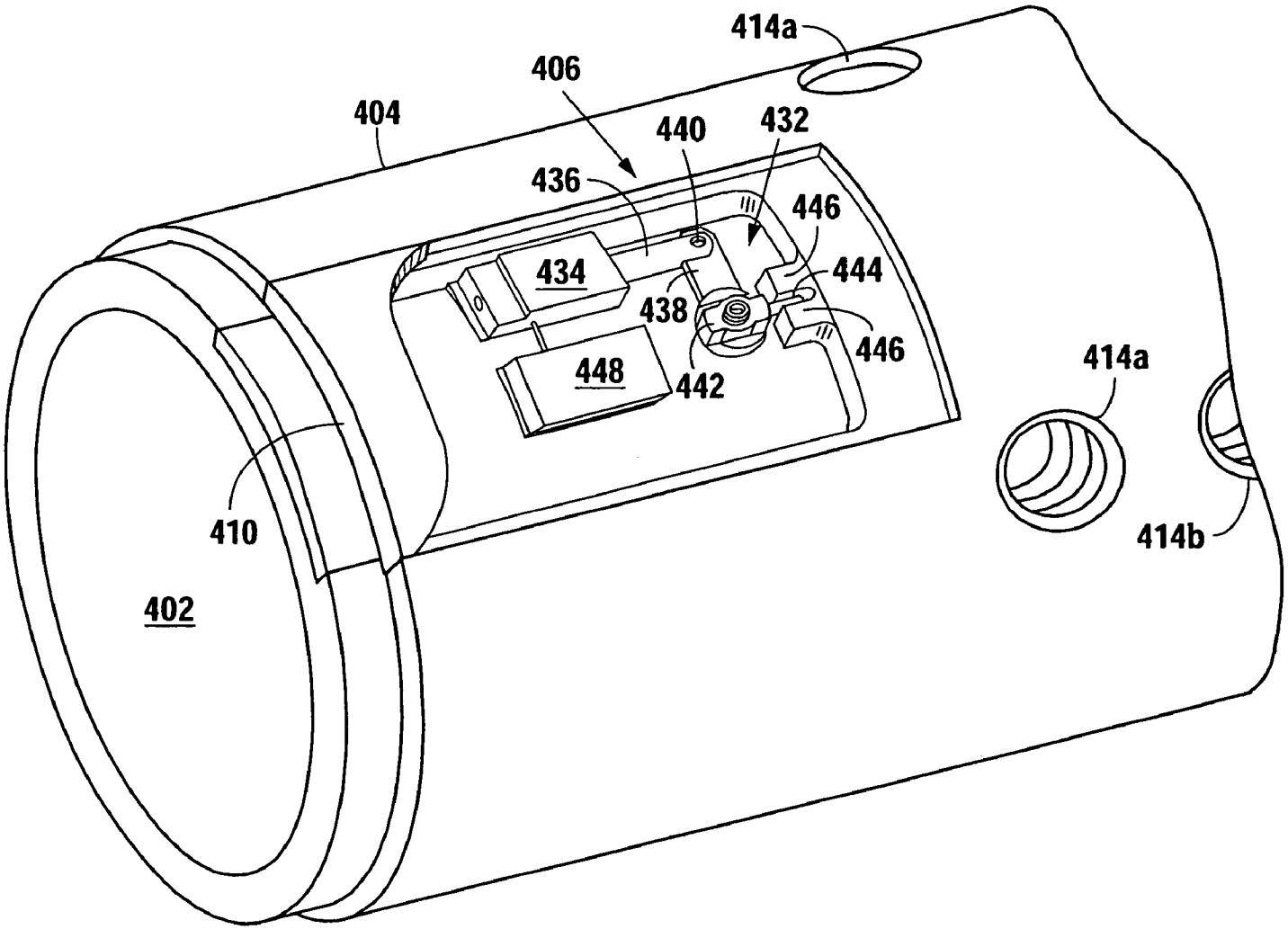
FIG. 11 shows a solenoid-and-cam assembly of the alternative embodiment of the valve.

As shown more fully in FIG. 11, the actuator means 406 are disposed within the annular space 410 formed between the casing 404 and sleeve 402. The actuator means 406 comprises a solenoid-and-cam assembly 432 having a solenoid 434 and finger 436 connected to a cam 438 by a securing pin 440. A cam follower pin 442 is disposed through the cam 438 into the casing 404 and includes an alignment pin 444 positioned between two pin guides 446. Receiver means 448 are also disposed within the annular space 410 and is electrically connected to the actuator means 406 to selectively trigger the energizing of the solenoid 434.

Figure 12B:
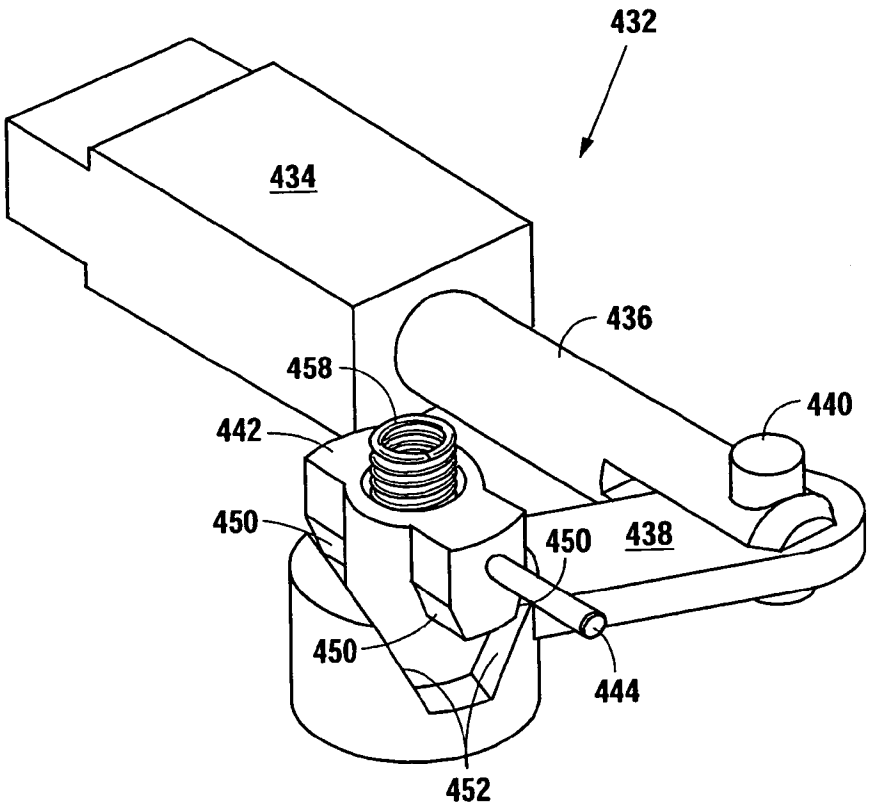
FIG. 12A and FIG. 12B more fully show the solenoid-and-cam assembly of the alternative embodiment in the "down" and "actuated" positions.
Figure 12A:
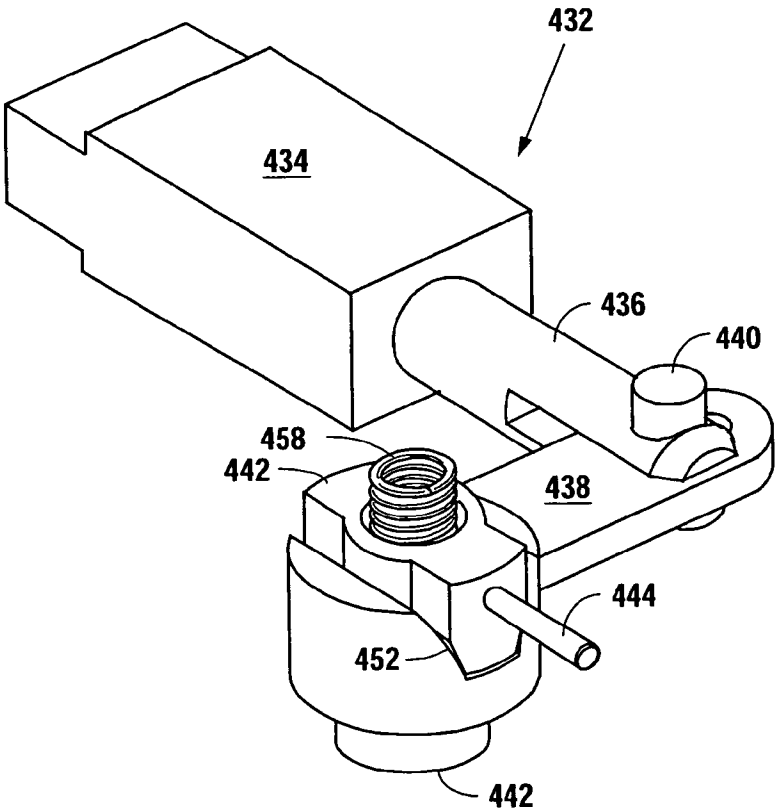

FIG. 12A and FIG. 12B more fully show the solenoid-and-cam assembly 432 in the "down" and "actuated" positions respectively. As shown in FIG. 12A, the solenoid 434 is connected to the finger 436 that, in turn, is secured to the cam 438 with a securing pin 440. The cam follower pin 442 has an attached alignment pin 444 and protrudes through the cam 438 into the casing 404 (not shown). In FIG. 12A, the solenoid-and-cam assembly 432 is in the "down" position.

FIG. 12B shows the solenoid-and-cam assembly 432 in the "actuated" position after the solenoid 434 has been energized to extend the attached finger 436. This extension rotates the cam 438 about the cam follower pin 442 causing the engagement surfaces 450 of the follower pin 442 to contact angled surfaces 452 of the cam 438.

Figure 13A:
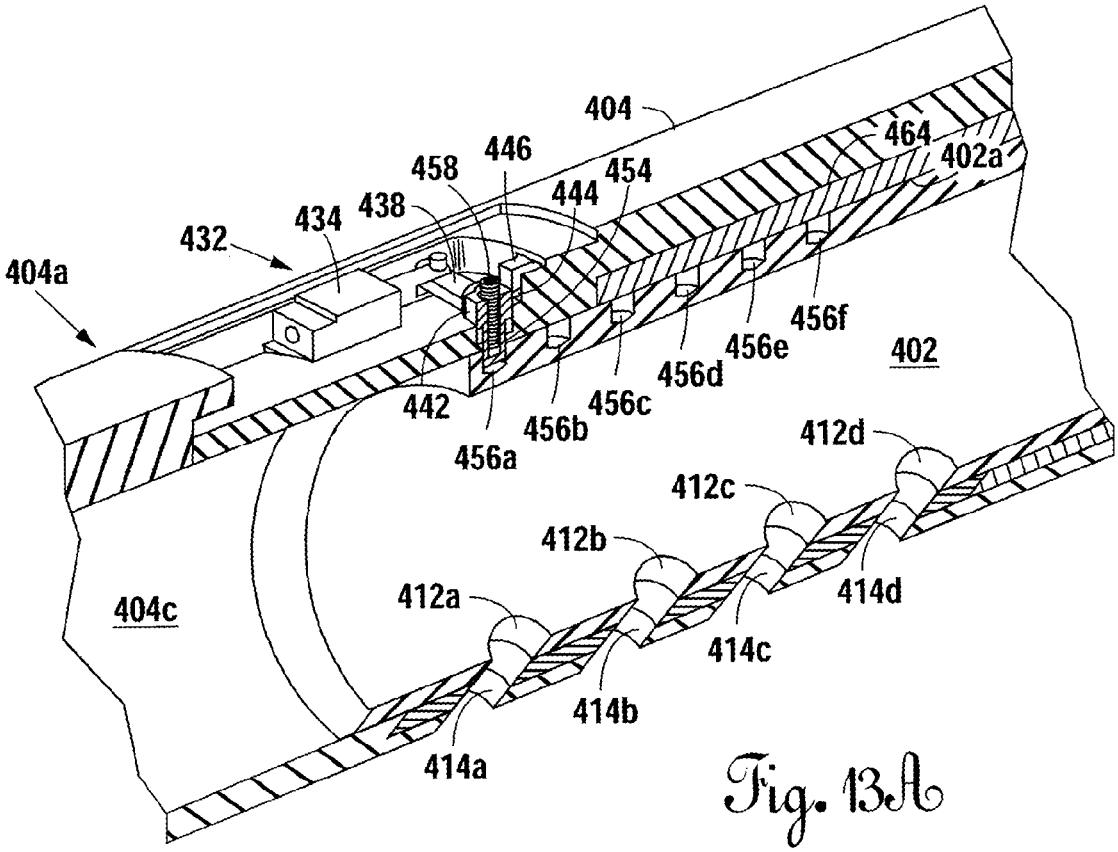
FIG. 13A and FIG. 13B more fully show how actuation of the solenoid-and-cam assembly permits sliding movement of the inner sleeve of the alternative embodiment.

As shown in FIG. 13A, because the follower pin 442 is disposed through a seating hole 454 in the casing 404, the follower pin 442 can only move radially outwardly from the casing 446. The alignment pin 444 is held between the two pin guides 446 (see FIG. 11) to prevent the follower pin 442 from rotating with the cam 438. Thus, during actuation, as the engagement surfaces 450 of the pin 442 move along the angled surfaces 452 of the cam 438 and the follower pin 442 is prevented from rotating with the cam 438 by the position of the alignment pin 444 between the guides 446, the pin 442 rises from the seating hole 454 so that the follower pin 442 no longer penetrates past inner surface 461 of the casing 404. In the actuated position, a spring 458 positioned extending from the follower pin 442 is compressed by the pin's upward movement to a casing 404. The spring 458 urges the follower pin 442 down into the cam 438.

A plurality of seating bores 456*a*-456*f* are aligned along the outer surface 402*a* of the inner sleeve 402 and positioned such that, as the inner sleeve 402 is urged linearly toward the upper end 404*a* of the casing 404, each of the bores 456*a*-456*f* will alternatively concentrically align with the seating hole 454 disposed through the casing 404. Initially, the cam follower pin 442 extends through the cam 438, through the seating hole 454, and into one of the seating bores 456*a*. This insertion prevents further movement of the inner sleeve 402 relative to the casing 404.

Figure 13B:
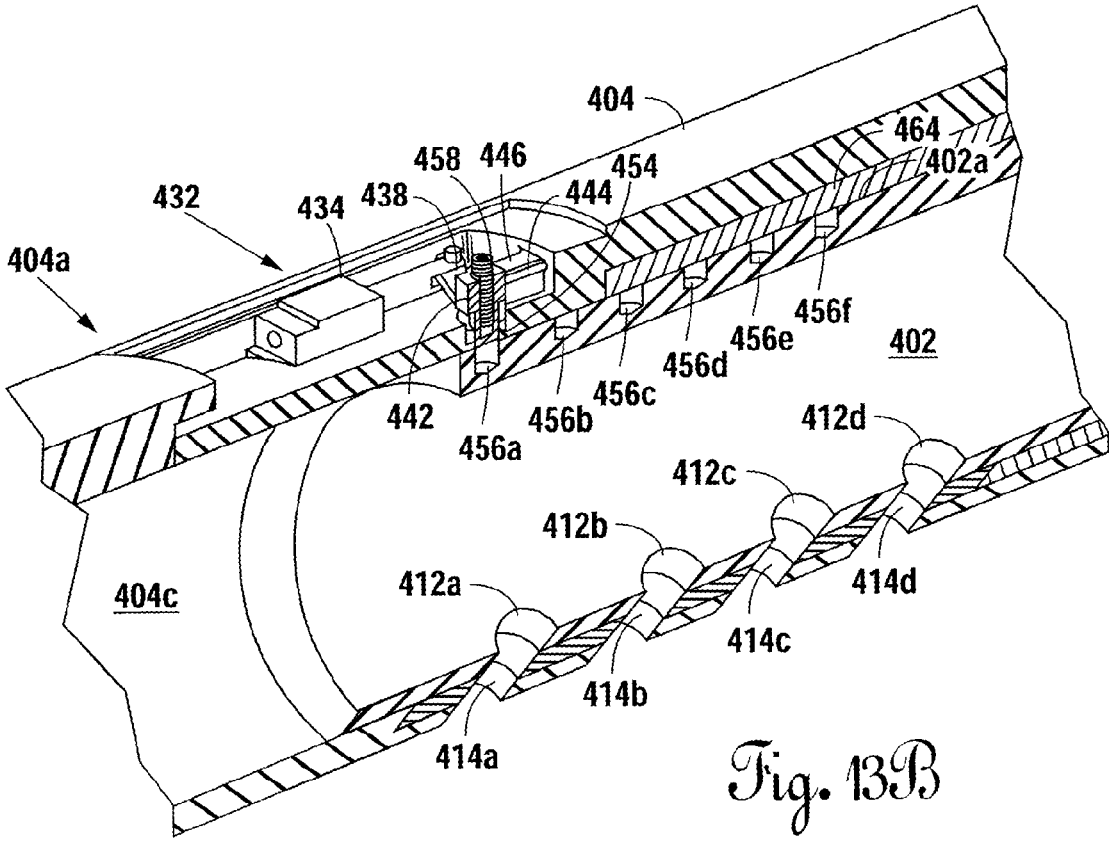

As shown in FIG. 13B, upon energizing the solenoid 434, the solenoid-and-cam assembly 432 moves to the "actuated" position as described with reference to FIG. 12B. In the actuated position, the follower pin 442 is removed from the previously-engaged seating bore 456*a*, which allows the inner sleeve 402 to move linearly toward the upper end 404*a* of the casing 404 from the urging of the compression spring 426 (see FIG. 10).

Shortly after actuation, the solenoid 434 is de-energized and expansive forces from the spring 458 positioned within the center of the cam follower pin 442 forces the follower pin 442 through the seating hole 454 and against the inner sleeve 402. As the next seating bore 456*b* in the inner sleeve 402 aligns with the seating hole 454, the follower pin 442 will be forced into the seating bore 456*b* by the spring 458, thus inhibiting further movement of the sleeve 402 until another actuation of the solenoid-and-cam assembly 432.

In typical operation, each actuation will allow the inner sleeve 402 to slide a distance equal to one half of the distance between two adjacent casing holes 414. Moreover, a complete open-close cycle requires two seating bores 456 for every casing hole 414*a*-414*d* in a casing hole row 415—the first of which aligns (or misaligns) the casing holes 414*a*-414*d* and sleeve holes 412 and the second of which then misaligns (or aligns) the casing holes 414 and sleeve holes 412. In addition, for the valve 400 to have equal effectiveness over multiple cycles, a sleeve hole row 413 must contain more holes than the casing hole row 415 with which it may be selectively aligned. For example, the valve 400 shown in FIG. 10 will operate fully for four cycles because the casing 404 comprises multiple rows 415 of four casing holes 414*a*-414-*d* each that will align with rows 413 of seven sleeve holes 412*a*-412*g*. Thus, the four casing holes 414*a*-414*d* in each row 415 are initially aligned with the first, second, third and fourth sleeve holes 412*a*-412*d* in each sleeve hole row 413, are aligned with the second, third, fourth, and fifth sleeve holes 412*b*-412*e* of each row 413 during the second open-close cycle, are aligned with the third, fourth, fifth and sixth sleeve holes 412*c*-412*f* of each row 413 during the third open-close cycle, and are aligned with the fourth, fifth, sixth, and seventh holes 412*d*-412*g* of each row 413 during the fourth actuation cycle.

During the fifth cycle, the first through third holes 414*a*-414*c* of each casing hole row will be aligned with the fifth, sixth, and seventh holes 412*e*-412*g* of each sleeve hole row 413; the fourth hole 414*d* of each casing hole row 415 will be closed off by the outer surface 402*a* of the inner sleeve 402. During the sixth cycle, the first and second holes 414*a*-414*b* of each casing hole row 415 will be aligned with the sixth and seventh holes 412*f*-412*g* of each sleeve hole row 413; the third and fourth holes 414*c*-414*d* of each casing hole row 415 will be closed off. During the seventh cycle, first hole 414*a* will be aligned with the seventh sleeve hole 412*g*; the remaining casing holes 414*b*-414*d* will be closed off. After the seventh cycle, all casing holes 414*a*-414*d* will be closed off, and the valve 400 must be reloaded, meaning the inner sleeve 402 moved down the tool such that the follower pin 442 is insertable through the seating hole 454 and into the first seating bore 456*a* and the compression spring 426 is recompressed to its initial position, before actuation of any additional open-close cycles.

The numbers of casing holes in each casing hole row 415 and sleeve holes in each sleeve hole row 413 is exemplary only, and the valve 400 may have more or fewer casing holes and sleeve holes in each row. Moreover, each row may have a different number of casing holes and sleeve holes.

Figure 14:
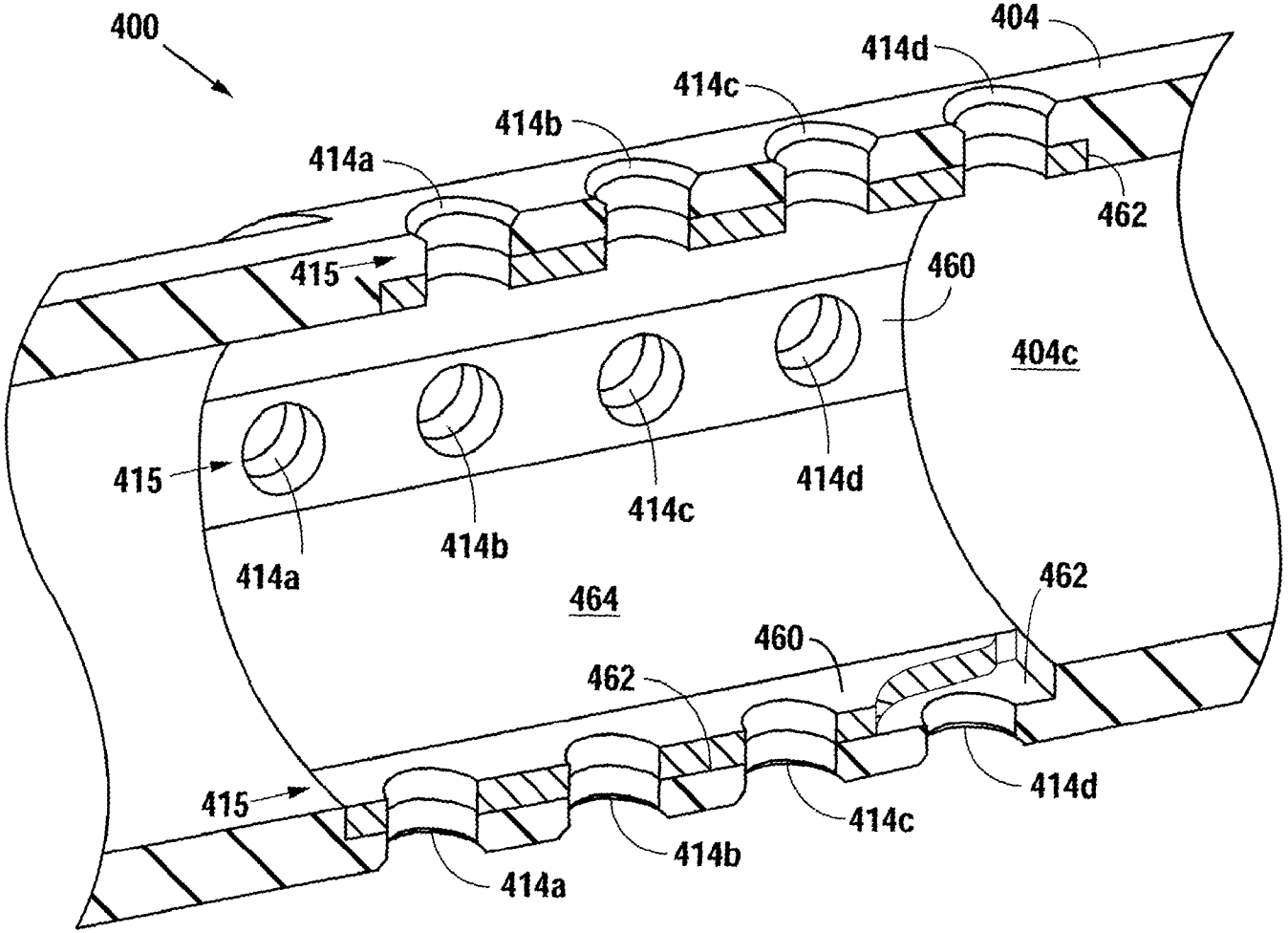
FIG. 14 depicts linearly-oriented seals at the location of the casing holes and disposed within a seal groove of the alternative embodiment.

As shown in FIG. 14, the valve 400 also contains seals 460, which are preferably HBNR, at the location of the casing holes 414*a*-414*d*, oriented linearly within a seal groove 462 circumferentially disposed in the inner surface 404*c* of the casing 404. Because these seals 460 often need to be replaced, a non-sealing and less-expensive packing material 464 may be used to fill space between the seals 460. The seals 460 provide the bulk of the resistance in sliding the inner sleeve 402 (not shown), and thus the frictional force generated by these surfaces must be estimated to derive spring properties such as wire thickness, number of active coils, overall length, and material. This analysis must be balanced against the force applied at the interface of the cam follower pin 442 and the sleeve bores 456, as well as the force, and thus power, requirements of the solenoid 434 (see FIGS. 12 & 13). These calculations are known to those having ordinary skill in the art of downhole tool design.

Figure 15:
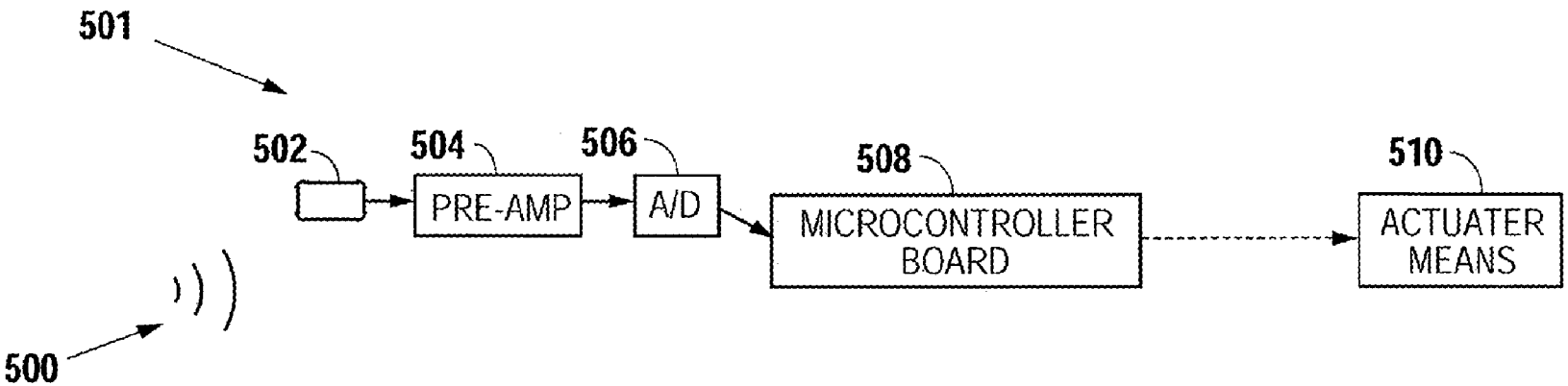
FIG. 15 more fully discloses receiver means for detecting mechanical energy generated by a seismic source and converting said mechanical energy into an electrical signal.

FIG. 15 more fully discloses receiver means 501 for detecting mechanical energy generated by a seismic source and converting that energy into an electrical signal. Incoming mechanical energy 500 generated remotely by a seismic source is received by a sensor 502 capable of detecting the energy 500 and converting it into an electrical signal. This signal is provided to a pre-amp circuit 504, which amplifies the signal to a level usable by the receiver means circuitry. The amplified signal is then provided to an analog-to-digital converter 506, which provides a digital representation of the acoustic energy 500 to a microcontroller 508. The microcontroller 508 selectively triggers the electrically-connected actuator means 510 to actuate a valve of the present invention.

According to alternative embodiments of the invention, the sensor 502 may be a geophone or a hydrophone. A geophone is a sensing device that detects ground movement (displacement) and converts it to an electrical signal that is proportional to the velocity of the displacement. Geophones are typically used on land to detect energy generated by seismic sources in oil, gas, and mineral exploration. Hydrophones are similar to geophones in that they are used to detect energy generated by seismic sources; however, instead of sensitivity to ground movement, they sense changes in water (or fluid) pressure. These pressure changes are then converted to an electrical signal. Because they are sensitive to pressure changes in fluid, they must be installed in some type of liquid (typically water). Both hydrophones and geophones are known to those having ordinary skill in the seismic arts.

Figure 16:
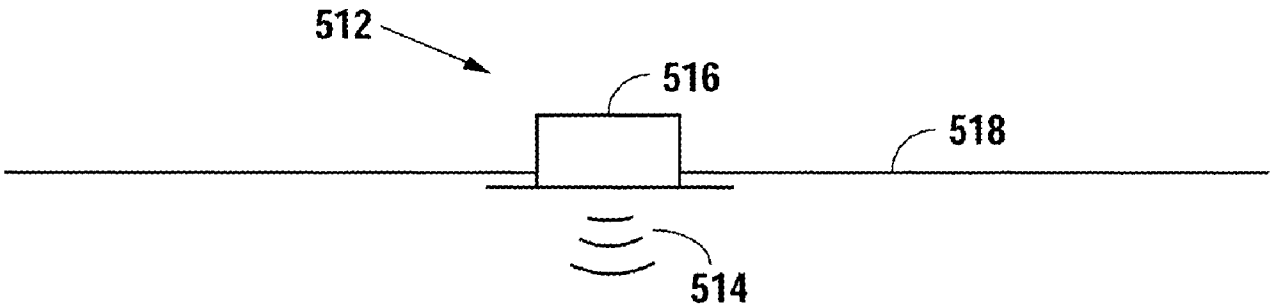
FIG. 16 more fully discloses source means for generating an acoustical signal receivable by said receiver means.

FIG. 16 more fully discloses source means 512 for generating an acoustical signal 514 into a ground surface 518 receivable by receiver means of a valve. As shown therein, the source means 512 comprises a seismic source 516 selected from the group consisting of accelerated weight drop, an air gun, vibroseis, and dynamite detonation. An accelerated weight drop (AWD) is an impulsive source that uses pressurized nitrogen to drive a large hammer-like device into a metal plate placed on the ground. An air gun is also an impulsive source that uses highly-compressed air to generate a pressure wave in water, and may be used either onshore (e.g., a borehole air gun) or offshore (e.g., a marine air gun). Vibroseis is an oscillatory source that uses a large baseplate and large reaction mass to vibrate the ground surface over an interval of time (usually from four to twelve seconds). The ground is vibrated by producing a sinusoidal sweep from one frequency to another (e.g., six to eighty Hz.). The sweep can be an upsweep (low to high frequency) or a downsweep (high to low frequency), and can be linear or non-linear. Each of these are known to those having ordinary skill in the seismic arts.

Figure 17:
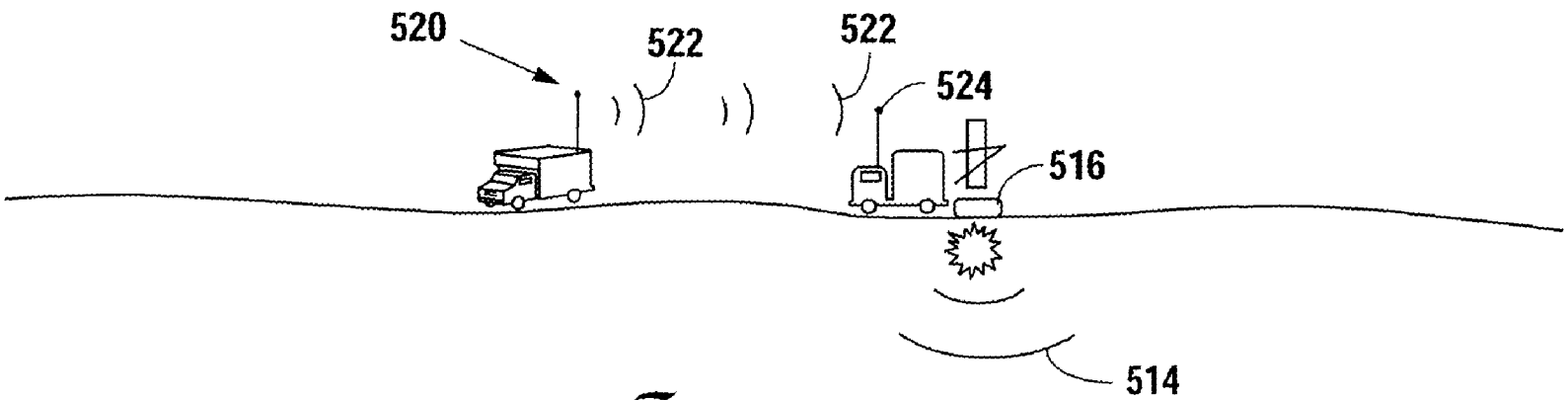
FIG. 17 illustrates source means including an encoder and decoder for remotely triggering the system's seismic source.

As shown in FIG. 17, according to one aspect of the present invention, the source means 512 may further comprise an encoder 520 and decoder for remotely triggering the system's seismic source 516. The well operator is proximally located to the encoder 520, into which a "fire" command may be entered. The "fire" command is encoded into an electromagnetic signal and transmitted to a remotely positioned decoder 524. At the decoder 524, the signal 522 is deconstructed and verified, after which the seismic source 516 is selectively triggered. This provides for greater safety because the "fire" command need not be given while in dangerous proximity to the seismic source 516. In addition, by remotely operating the source 516, the source 516 may be moved relative to the encoder 520 if necessary to create the strongest possible acoustic signal 514 to the valve.

Figure 18:
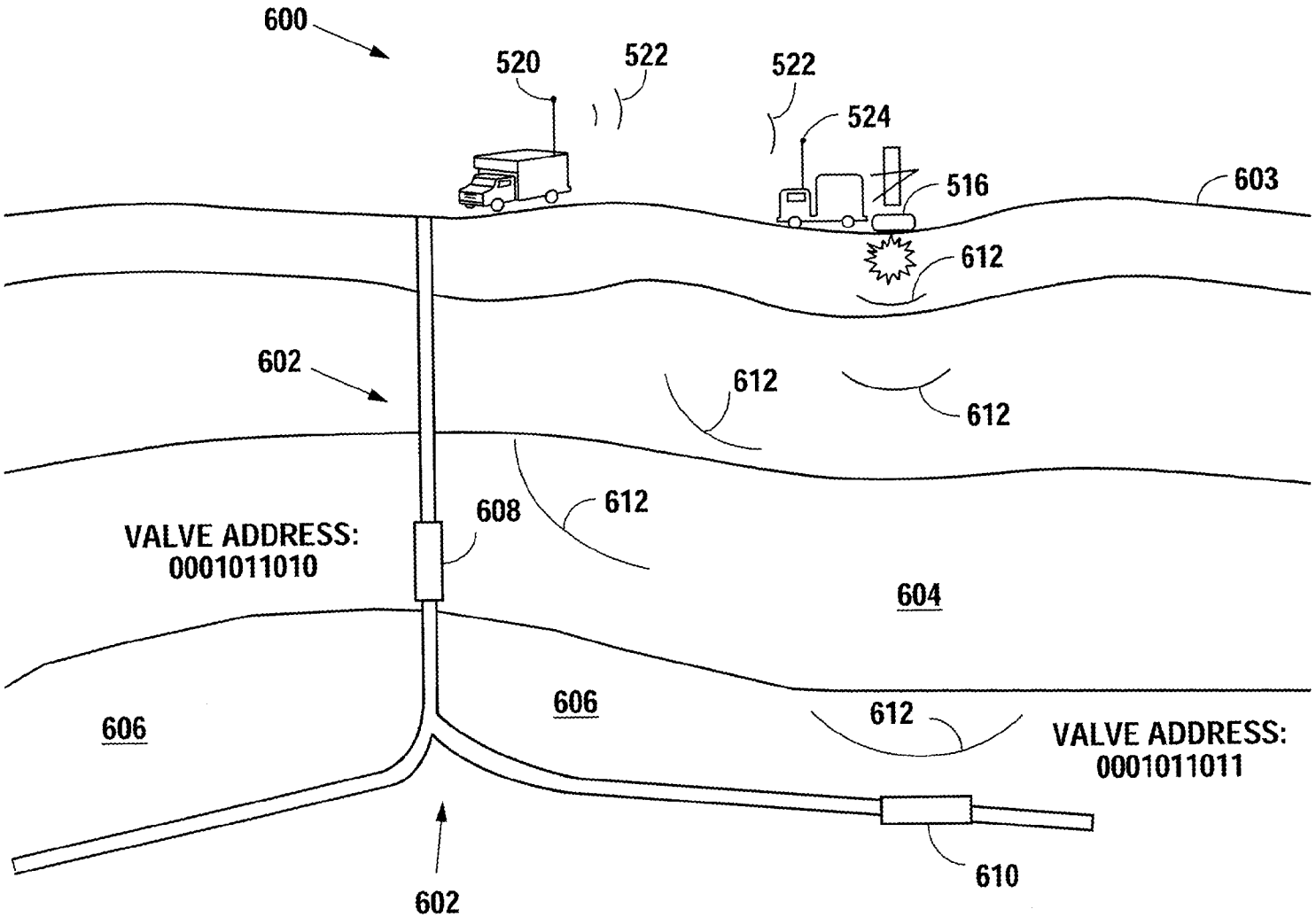
FIG. 18 discloses an embodiment of the system of the present invention.

FIG. 18 discloses a system 600 of the present invention that is disposed into earth 603 having an upper 604 and a lower hydrocarbon production zone 606. A production well 602 is drilled into the earth 603 and penetrates into the productions zones 604, 606. A first selectively-actuatable fracing valve 608 of the present invention is disposed in the upper production zone 604 and has a unique system address [0001011010], and a second selectively-actuatable fracing valve 610 of the present invention is disposed in the lower production zone 606 and has unique system address [0001011011].

As described with reference to FIG. 17, to open or close a valve of the system 600, the well operator enters an appropriate command into an encoder 520. The "fire" command is encoded into an electromagnetic signal 522 and transmitted to a remotely-positioned decoder 524. At the decoder 524, the signal 522 is deconstructed and verified, after which the seismic source 516 is selectively triggered.

In order to communicate with a specific valve disposed in the production well 602, a series of acoustic signals needs to be transmitted to the appropriate valve using a predetermined communication protocol, which is preferably On-Off Keying. On-Off Keying (OOK) is a modulation technique according to which the presence of a signal over an expected interval of time represents a binary one, whereas the absence of signal over the same interval represents a binary zero. The presence of a signal 612 can be acknowledged when the average energy over a determined time interval exceeds a specific threshold value. While preferred, the use of OOK as described herein is exemplary, and other communication protocols may be used, including amplitude modulation, frequency modulation, and arrival time encoding.

OOK is preferable because it is not as sensitive as the other approaches to the changes that the original signal 612 will undergo as it propagates from the seismic source 516 to the valves' 608, 610 receiver means through the rock strata. Some of the changes include severe loss of amplitude at many of the frequencies, phase distortions, ambient noise convolved with the signal, along with the multi-path arrivals. OOK depends only upon the signal 612 being present or absent during the required time interval, and not the finer details of the signal character.

According to the preferred embodiment of the system, an OOK communication packet from a seismic source conveys a training pulse, a preamble, a command (e.g., "open valve" or "close valve"), an address, and an error detection code. The training pulse is simply one pulse sent by the transmitting source to wake up all of the idle receiver units and indicate that communication is about to take place.

Figure 19:
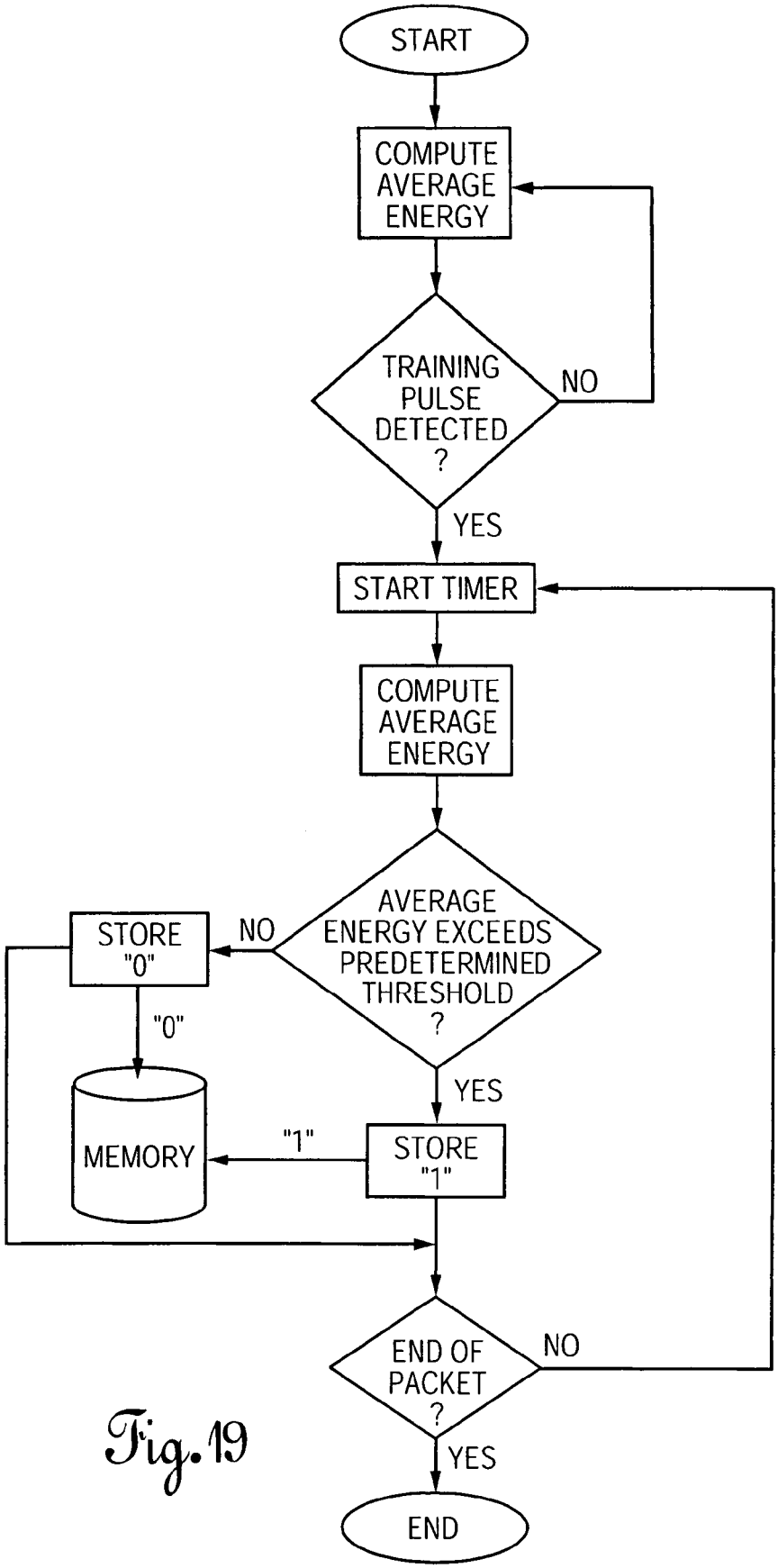
FIG. 19 shows a flowchart of the On-Off Keying (OOK) communication protocol preferably used to communicate with a valve of the present invention.

As shown in FIG. 19, before the training pulse is sent, the receiver means at each valve in the system is in idle mode continually computing average energy over a specific time window (e.g., 200 milliseconds). As soon as a specific threshold value is exceeded over the window, the unit will start an internal timer to expect the arrival (or absense) of subsequent pulses that make up the packet at a predetermined pulse interval (e.g., fifteen seconds). To determine the binary values of the packet, each receiver unit will compute average energy over the window starting at the pulse interval. If average energy exceeds the threshold, a binary "one" has been sent; if not, a binary "zero" has been sent.

Figure 20:
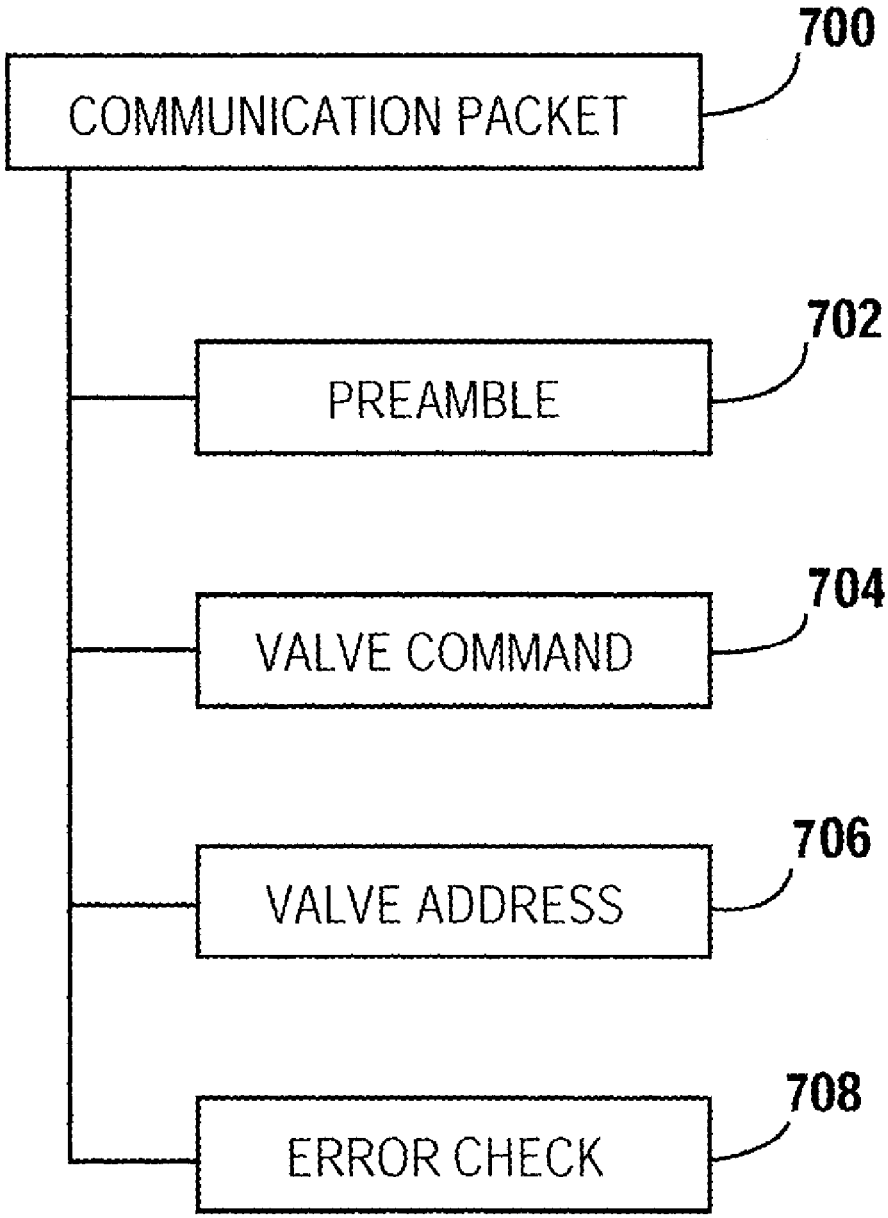
FIG. 20 represents the format of a preferred communication packet used in the system.

FIG. 20 discloses the communication packet 700 preferably used by the system of the present invention. The preamble 702 is a predetermined series of binary digits (e.g., 10101) and is used to let each valves' receiver means know that appropriate communication is now taking place. If the preamble does not match the predetermined series of bits, the receiver unit knows that the signal is coming from something unrelated to valve actuation or perhaps an unrelated system, and will go back to idle mode; otherwise, it continues to process the packet 700 on the pulse interval. A small series of bits—for example, three—will follow the preamble 702 to indicate the valve command 704. Typically the command would be used to open or close a particular valve, or open or close all the valves (i.e., a "broadcast" command for all valves to open or close). The particular valve to open or close is indicated by the valve address 706 bits. For example, ten address bits would be capable of addressing 1024 different valves (i.e., $2^{10}$). A group of error check bits 708 is used by the receiver means to determine if an error occurred during transmission. For example, a checksum or parity bits could be used.

The present invention is described above in terms of a preferred illustrative embodiments of a specifically described selectively-actuatable valve, system, and method. Those skilled in the art will recognize that alternative constructions can be used in carrying out the present invention. Other aspects, features, and advantages of the present invention may be obtained from a study of this disclosure and the drawings, along with the appended claims.

We claim:

1. A selectively-actuatable fracing valve comprising:

a generally-cylindrical casing having at least one casing hole;

a generally-cylindrical inner sleeve nested within said casing and having at least one sleeve hole alignable with said at least one casing hole;

actuator means for moving said inner sleeve relative to said casing and selectively aligning said at least one sleeve hole with said at least one casing hole; and receiver means electrically connected to said actuator means for detecting mechanical energy generated by a seismic source and converting said mechanical energy into an electrical signal;

said inner sleeve has at least one seating bore disposed therein; and said actuator means comprises:

a compression spring urging said inner sleeve linearly within said casing; and a solenoid-and-cam assembly affixed to said casing and having a cam follower pin insertable into said at least one seating bore.

2. The fracing valve of claim 1 wherein said receiver means includes a sensor selected from the group consisting of a geophone and a hydrophone.

3. A remotely-operated selective fracing system comprising:

at least one selectively-actuatable fracing valve, said valve comprising:

a generally-cylindrical casing having at least one casing hole;

a generally-cylindrical inner sleeve nested within said casing and having at least one sleeve hole alignable with said at least one casing hole;

actuator means engagable with said inner sleeve for moving said inner sleeve relative to said casing and selectively aligning said at least one sleeve hole with said at least one casing hole; and receiver means electrically connected to said actuator means for detecting mechanical energy generated by a seismic source and converting said mechanical energy into an electrical signal;

said inner sleeve has at least one seating bore disposed therein; and said actuator means comprises:

a compression spring urging said inner sleeve linearly within said casing; and a solenoid-and-cam assembly affixed to said casing and having a cam follower pin insertable into said at least one seating bore; and source means for generating an acoustical signal receivable by said receiver means.

4. The system of claim 3 wherein said source means comprises a seismic source.

5. The system of claim 4 wherein said seismic source is selected from the group consisting of accelerated weight drop, an air gun, vibroseis, and dynamite detonation.

6. The system of claim 4 wherein said source means further comprises:

a decoder in communication with said seismic source; and an encoder in communication with said decoder.

7. A method of remotely actuating a selectively actuatable fracing valve having a generally-cylindrical inner sleeve nested within a casing, said method comprising:

generating an encoded signal receivable by receiver means of said valve;

receiving said signal at said valve;

selectively actuating said valve;

applying an expansive force to said sleeve;

resisting movement of said sleeve urged by said expansive force with a cam follower pin disposed into a first seating bore disposed in said sleeve;

removing said pin from said first seating bore; and disposing said pin into a second seating bore disposed in said sleeve.

8. The method of claim 7 wherein said encoded signal is acoustic and said generating step comprises causing a series of acoustic signals according to a predetermined communication protocol.

9. The method of claim 7 wherein said encoded signal is electromagnetic and said generating step comprises transmitting said signal through the earth.

10. The method of claim 7 wherein said encoded signal is electromagnetic and said generating step comprises transmitting said signal through a production well casing.

11. The method of claim 7 wherein said encoded signal is electromagnetic and said generating step comprises pumping a control ball into a production well, said control ball being capable of emitting said signal from within said production well.

* * * * *